US009141028B2

(12) United States Patent
Tsuritani et al.

(10) Patent No.: US 9,141,028 B2
(45) Date of Patent: Sep. 22, 2015

(54) IMAGE FORMING APPARATUS AND DEVELOPER CONTAINER, DEVELOPING DEVICE, PROCESS UNIT, AND REPLACEABLE UNIT THEREFOR

(71) Applicants: Shoh Tsuritani, Osaka (JP); Manabu Hamada, Osaka (JP); Tomohiro Kubota, Osaka (JP); Yoshiyuki Shimizu, Osaka (JP)

(72) Inventors: Shoh Tsuritani, Osaka (JP); Manabu Hamada, Osaka (JP); Tomohiro Kubota, Osaka (JP); Yoshiyuki Shimizu, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/967,587

(22) Filed: Aug. 15, 2013

(65) Prior Publication Data

US 2014/0050502 A1 Feb. 20, 2014

(30) Foreign Application Priority Data

Aug. 17, 2012 (JP) ..... 2012-180978

(51) Int. Cl.

*G03G 15/00* (2006.01)
*G03G 15/08* (2006.01)
*G03G 21/16* (2006.01)

(52) U.S. Cl.

CPC ..... *G03G 15/0832* (2013.01); *G03G 15/0865* (2013.01); *G03G 15/0875* (2013.01); *G03G 15/0886* (2013.01); *G03G 15/80* (2013.01); *G03G 21/1676* (2013.01); *G03G 21/1647* (2013.01)

(58) Field of Classification Search

USPC ..... 399/90, 111, 119, 120
See application file for complete search history.

(56) References Cited

U.S. PATENT DOCUMENTS

| | | | | |
|---|---|---|---|---|
| 8,467,700 | B2 * | 6/2013 | Okabe | 399/110 |
| 2007/0297840 | A1 * | 12/2007 | Onodera | 399/358 |
| 2010/0231142 | A1 * | 9/2010 | Yoon | 315/312 |
| 2011/0229197 | A1 | 9/2011 | Tada et al. | |
| 2013/0028638 | A1 | 1/2013 | Tsuritani et al. | |
| 2013/0266347 | A1 | 10/2013 | Kubota et al. | |

FOREIGN PATENT DOCUMENTS

| | | |
|---|---|---|
| JP | 2004-045857 | 2/2004 |
| JP | 2006-184850 | 7/2006 |
| JP | 2011-197271 | 10/2011 |

OTHER PUBLICATIONS

U.S. Appl. No. 13/908,434, filed Jun. 3, 2013.
U.S. Appl. No. 13/907,083, filed May 31, 2013.

* cited by examiner

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

An image forming apparatus includes an apparatus body, an apparatus-side terminal provided to a first inner side wall of the apparatus body, a developer container to contain developer and to be removably installable in the apparatus body, a container-side terminal electrically connectable to the apparatus-side terminal and disposed in a first end portion of the developer container in a longitudinal direction thereof, and an apparatus-side protrusion projecting inward from the first inner side wall of the apparatus body. In removal of the developer container from the apparatus body, a second end portion of the developer container in the longitudinal direction is disengaged from the apparatus body before the first end portion is disengaged from the apparatus body, and the apparatus-side protrusion contacts the first end portion of the developer container immediately after removal of the developer container from the apparatus body is started.

13 Claims, 24 Drawing Sheets

IMAGE FORMING APPARATUS AND DEVELOPER CONTAINER, DEVELOPING DEVICE, PROCESS UNIT, AND REPLACEABLE UNIT THEREFOR

CROSS-REFERENCE TO RELATED APPLICATION

This patent application is based on and claims priority pursuant to 35 U.S.C. §119 to Japanese Patent Application No. 2012-180978, filed on Aug. 17, 2012, in the Japan Patent Office, the entire disclosure of which is hereby incorporated by reference herein.

BACKGROUND OF THE INVENTION

1. Technical Field

The present invention generally relates to a developer container for containing powder used for image formation and an image forming apparatus, such as, a copier, a printer, a facsimile machine, a plotter, the like, or a multifunction machine (or multifunction peripheral) that includes the developer container and has at least two of capabilities of copying, printing, plotting, scanning, facsimile transmission, and the like. The present invention further relates to a replaceable unit removably installable in an apparatus.

2. Description of the Background Art

Electrophotographic image forming apparatuses, such as copiers, printers, facsimile machines, and multifunction machines including at least two of such capabilities, generally include a developing device to develop, with developer such as toner, latent images formed on a photoreceptor serving as an image bearer. As toner is consumed to develop latent images, the developing device is replenished with toner.

To replenish the developing device, replaceable toner cartridges filled with toner are often used. For example, an upper cover of the image forming apparatus is opened, the used toner cartridge is removed therefrom, and a new toner cartridge is installed therein.

Replaceable units, such as toner containers (or toner cartridges), process units (or process cartridges), or the like, are typically provided with a data storage element to store data relating to each cartridge. In such configurations, the replaceable unit further includes a terminal (hereinafter "unit-side terminal") connected to the data storage element, and the apparatus body includes a terminal (hereinafter "apparatus-side terminal") electrically connectable to the unit-side terminal to transmit data from the replaceable unit to a controller of the apparatus. For example, in JP-2011-197271-A, electrical contacts are provided to the process cartridge and the apparatus body to form electrical connection therebetween in a state in which the process cartridge is mounted in the apparatus body.

The unit-side terminal is often disposed on an end face at one longitudinal end of the replaceable unit, and the apparatus-side terminal is disposed on an inner side wall of the apparatus body facing the end face of the replaceable unit.

SUMMARY OF THE INVENTION

In view of the foregoing, one embodiment of the present invention provides an image forming apparatus that includes an apparatus body, an apparatus-side terminal provided to the apparatus body, and a developer container to contain developer, removably installable in the apparatus body. Additionally, a container-side terminal that is electrically connectable to the apparatus-side terminal is provided to a first end portion of the developer container in a longitudinal direction thereof, and the apparatus body further includes an apparatus-side protrusion projecting inward from a first inner side wall of the apparatus body. In removal of the developer container from the apparatus body, a second end portion of the developer container in the longitudinal direction is disengaged from the apparatus body before the first end portion is disengaged from the apparatus body, and the apparatus-side protrusion contacts the first end portion of the developer container immediately after removal of the developer container from the apparatus body is started.

Another embodiment provides a developer container to contain developer, removably installable in an apparatus body of an image forming apparatus. The developer container includes the container-side terminal and a grip for being gripped by an operator or user in installation and removal of the developer container. The grip is disposed at a position shifted to a second end portion from a longitudinal center of the developer container.

Yet another embodiment provides a development housing to contain developer, a developer bearer to supply developer contained in the development housing to a latent image formed on a latent image bearer, and the above-described developer container to contain developer supplied to the development housing.

Yet another embodiment provides a process unit removable installable in an apparatus body. The process unit includes the above-described developing device and the latent image bearer on which a latent image is formed.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
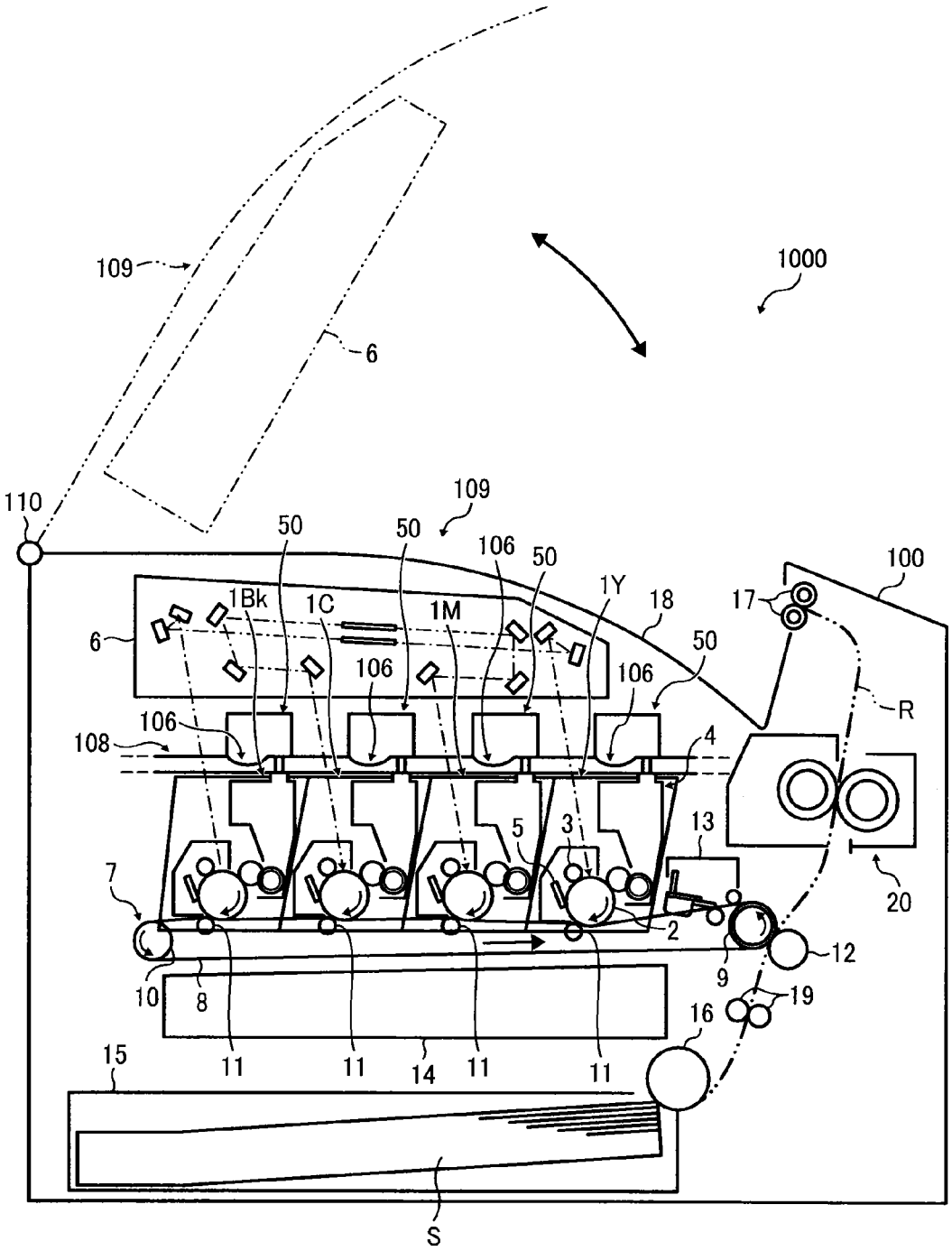
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It will be understood that if an element or layer is referred to as being "on," "against," "connected to" or "coupled to" another element or layer, then it can be directly on, against, connected, or coupled to the other element or layer, or intervening elements or layers may be present. In contrast, if an element is referred to as being "directly on", "directly connected to" or "directly coupled to" another element or layer, then there are no intervening elements or layers present. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Embodiments described below concerns a replaceable unit removably installable in an apparatus body.

According to an aspect of the present specification, while the contact between the developer container and the apparatus-side terminal is inhibited in removal of the developer container, the capacity of the developer container can be increased, or the image forming apparatus can be reduced in size.

Referring now to the drawings, wherein like reference numerals designate identical or corresponding parts throughout the several views thereof, and particularly to FIG. 1, a multicolor image forming apparatus according to an embodiment of the present invention is described.

Although the image forming apparatus in the present embodiment is a multicolor laser printer, embodiments of the present invention are not limited thereto. Alternatively, the image forming apparatus to which various aspects of this disclosure are applied can be single-color or multicolor printers of other types, copiers, facsimile machines, or multifunction machines having these capabilities.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

In an image forming apparatus 1000 shown in FIG. 1, four process units 1Y, 1M, 1C, and 1Bk are removably installed in an apparatus body 100 thereof. The process units 1Y, 1M, 1C, and 1Bk respectively contain yellow (Y), magenta (M), cyan (C), and black (Bk) developer corresponding to decomposed color components of full-color images and have a similar configuration except the color of developer contained therein.

More specifically, each process unit 1 includes a drum-shaped photoreceptor 2 serving as a latent image bearer, a charging device including a charging roller 3 to charge the surface of the photoreceptor 2, a developing device 4 to supply toner to a latent image formed on the photoreceptor 2, and a cleaning unit including a cleaning blade 5 to clean the surface of the photoreceptor 2. It is to be noted that, in FIG. 1, the photoreceptor 2, the charging roller 3, the developing device 4, and the cleaning blade 5 of only the process unit 1Y for yellow are given reference numerals, and reference numerals of those of other process units 1M, 1C, and 1Bk are omitted. It is to be noted that, although one-component developer consisting essentially of toner (toner particles) is used in the present embodiment, two-component developer consisting essentially of carrier (carrier particles) and toner may be used instead.

A toner cartridge 50 serving as a developer container is provided above the developing device 4 in each process unit 1. The toner cartridge 50 contains toner supplied to the developing device 4. In the present embodiment, a partition 108, which is a part of a base 107 (shown in FIG. 15, described later), is disposed between the developing devices 4 and the toner cartridges 50. The toner cartridges 50 are removably attached to respective container mounts 106 formed in the partition 108.

Additionally, an exposure unit 6 is provided above the toner cartridges 50 in FIG. 1 to expose to light the surface of each photoreceptor 2. The exposure unit 6 is configured to direct laser beams onto the surfaces of the photoreceptors 2 according to image data, and includes a light source, a polygon mirror, an f-O lens, and reflection mirrors.

The image forming apparatus 1000 further includes an upper cover 109 hinged to the apparatus body 100. The upper cover 109 can pivot about a fulcrum 110 and be lifted or lowered to open or close an upper side of the apparatus body 100. The exposure unit 6 is attached to the upper cover 109. Accordingly, when the upper cover 109 is lifted, the exposure unit 6 can be moved away from the toner cartridges 50, and the toner cartridges 50 can be removed from the apparatus body 100 through the upper opening in this state.

Additionally, a transfer device 7 is provided beneath the process units 1. The transfer device 7 includes an intermediate transfer belt 8 that can be, for example, an endless belt onto and from which a toner image is transferred. The intermediate transfer belt 8 is stretched around support rollers, namely, a driving roller 9 and a driven roller 10. As the driving roller 9 rotates counterclockwise in FIG. 1, the intermediate transfer belt 8 rotates in the direction indicated by an arrow shown in FIG. 1.

The image forming apparatus 1000 further includes four primary-transfer rollers 11 positioned facing the respective photoreceptors 2 via the intermediate transfer belt 8. Each primary-transfer roller 11 is pressed against the inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage.

Additionally, a secondary-transfer roller 12 is provided at a position facing the driving roller 9 via the intermediate transfer belt 8. The secondary-transfer roller 12 is pressed against the outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

Additionally, a belt cleaning unit 13 to clean the surface of the intermediate transfer belt 8 is provided facing a right end portion of the intermediate transfer belt 8 from the outer circumferential side in FIG. 1. A waste toner conveyance hose (tube) is connected to the belt cleaning unit 13 as well as an inlet of a waste toner container 14 provided beneath the transfer device 7.

Beneath the apparatus body 100, a sheet tray 15 that can contain sheets S of recording media, such as paper or overhead projector (OHP) films, is provided. The sheet tray 15 is provided with a feed roller 16 to pick up and transport the sheets S from the sheet tray 15. Additionally, a pair of discharge rollers 17 is provided in an upper portion of the apparatus body 100 to discharge the sheets S outside, and the sheets S thus discharged are stacked on a discharge tray 18 formed in the upper cover 109. The recording media include, in addition to standard copy paper, heavy paper, post cards, thin paper such as tracing paper, coated paper, overhead projector (OHP) films, and special purpose sheets.

A conveyance path R is formed inside the apparatus body 100, and the sheet S is conveyed from the sheet tray 15 to the secondary-transfer nip and further to the discharge tray 18 along the conveyance path R. Along the conveyance path R, a pair of registration rollers 19 is provided upstream from the secondary-transfer roller 12 in the direction in which the sheet S is transported (hereinafter "sheet conveyance direction"), and a fixing device 20 is provided downstream from the secondary-transfer roller 12 in that direction.

The image forming apparatus 1000 configured as described above operates as follows.

When image formation is started, the photoreceptors 2 in the respective process units 1 are rotated clockwise in FIG. 1, and the charging rollers 3 uniformly charge the surfaces of the photoreceptors 2 to a predetermined polarity. Then, the exposure unit 6 directs laser beams onto the charged surfaces of the respective photoreceptors 2 according to, for example, image data of originals read by a reading unit. Thus, electrostatic latent images are formed on the respective photoreceptors 2. More specifically, the exposure unit 6 directs the laser beams according to single color data, namely, yellow, cyan, magenta, and black color data decomposed from full-color image data to the surfaces of the photoreceptors 2. The electrostatic latent images formed on the photoreceptors 2 are developed into toner images with toner supplied by the respective developing devices 4.

Meanwhile, the driving roller 9 rotates, and accordingly the intermediate transfer belt 8 rotates in the direction indicated by the arrow shown in FIG. 1. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method. The transfer electrical fields generated in the primary-transfer nips transfer the toner images from the respective photoreceptors 2 and superimpose them one on another on the intermediate transfer belt 8. Thus, a multicolor toner image is formed on the intermediate transfer belt 8. After primary transfer, the cleaning blades 5 remove toner remaining on the respective photoreceptors 2.

Meanwhile, the feed roller 16 rotates, thereby sending out the sheet S from the sheet tray 15 to the conveyance path R. Then, the registration rollers 19 forward the sheet S to the secondary-transfer nip formed between the secondary-transfer roller 12 and the intermediate transfer belt 8, timed to coincide with the multicolor toner image (superimposed single-color toner images) formed on the intermediate transfer belt 8. At that time, the transfer bias voltage whose polarity is opposite that of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet S at a time. The belt cleaning unit 13 removes toner remaining on the intermediate transfer belt 8 (i.e., waste toner) after image transfer, and the waste toner is collected in the waste toner container 14.

Subsequently, the sheet S carrying the toner image is transported to the fixing device 20, and the fixing device 20 fixes the toner image on the sheet S. The pair of discharge rollers 17 discharges the sheet S onto the discharge tray 18.

It is to be noted that, although the description above concerns multicolor image formation, alternatively, the image forming apparatus 1000 can form single-color images, bicolor images, or three-color images using one, two, or three of the four process units 1.

Figure 2:
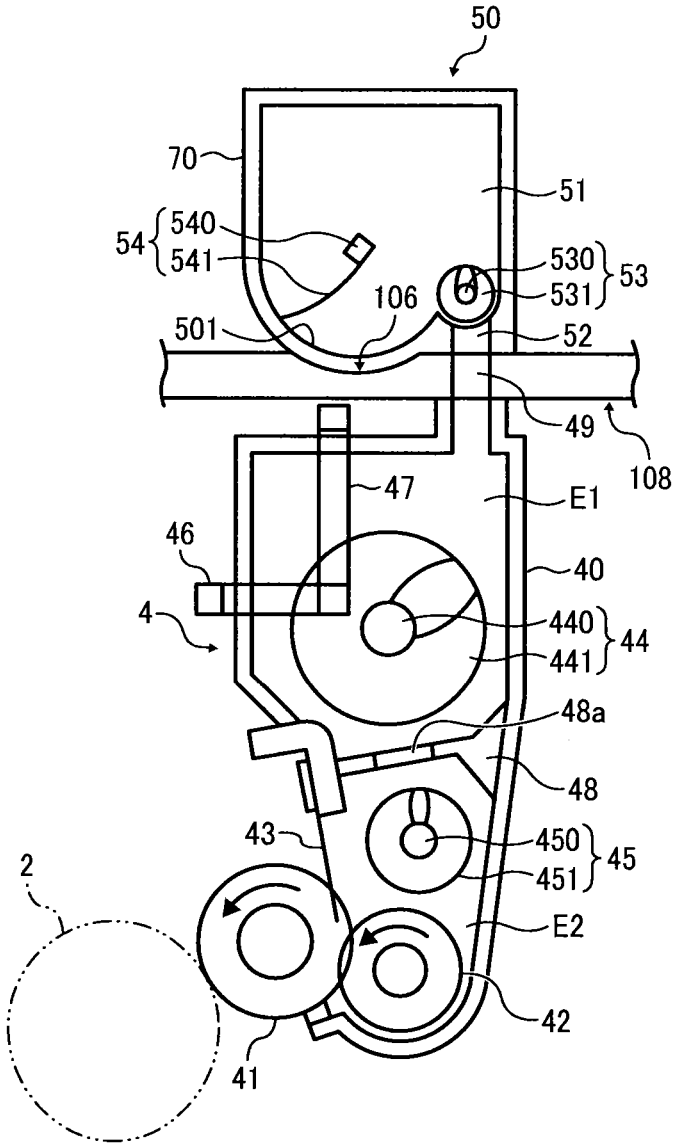
FIG. 2 is a schematic end-on axial view of a developing device and a toner cartridge according to an embodiment.

As shown in FIG. 2, the developing device 4 according to the present embodiment includes a development housing 40 that contains developer (e.g., toner), a developing roller 41 serving as a developer bearer, a supply roller 42 serving as a developer supply member to supply toner to the developing roller 41, a doctor blade 43 serving as a developer regulator to adjust the amount of toner carried on the developing roller 41, and first and second developer conveying screws 44 and 45 serving as developer conveying members to transport the developer (e.g., toner).

A partition 48 divides an interior of the development housing 40 into a first compartment (upper compartment) E1 and a second compartment (lower compartment) E2 arranged vertically, and an opening 48*a* is formed in either end portion of the partition 48 in the direction perpendicular to the surface of the paper on which FIG. 2 is drawn. That is, the first compartment E1 and the second compartment E2 can communicate with each other via the openings 48*a* formed in the partition 48.

The conveying screw 44 is disposed in the first compartment E1, and the conveying screw 45 and the supply roller 42 are situated in the second compartment E2. The developing roller 41 and the doctor blade 43 are provided at an opening through which the second compartment E2 faces the photoreceptor 2.

The conveying screw 44 includes a rotary shaft 440 and a spiral blade 441 winding around the outer circumference of the rotary shaft 440. Similarly, the conveying screw 45 includes a rotary shaft 450 and a spiral blade 451 winding around the outer circumference of the rotary shaft 450. The conveying screws 44 and 45 are configured to transport toner axially and in the opposite directions by rotation.

The developing roller 41 includes a metal core and a conductive elastic layer made of, for example, rubber, overlying the metal core. In the present embodiment, for example, the metal core has an external diameter of 6 mm, and the conductive elastic layer has an outer diameter of 12 mm and JIS hardness (Hs) of 75. Additionally, the conductive elastic layer is designed to have a volume resistivity of about $10^5\Omega$ to $10^7\Omega$. For example, conductive urethane rubber or silicone rubber may be used for the conductive elastic layer. The developing roller 41 rotates counterclockwise in FIG. 2 as indicated by an arrow and transports the developer carried thereon to a position facing the doctor blade 43 and a position facing the photoreceptor 2.

Typically, a sponge roller can be used as the supply roller 42. The sponge roller including a metal core and semiconducting foam polyurethane adhering to the metal core is suitable. Foam polyurethane can be made semiconducting by mixing carbon therein. In the present embodiment, the metal core of the supply roller 42 has an external diameter of about 6 mm, and the sponge layer has an external diameter of about 12 mm, for example. The supply roller 42 is disposed in contact with the developing roller 41. The size of a nip formed between the supply roller 42 and the developing roller 41 in contact with each other is typically about 1 mm to 3 mm. In the present embodiment, the size of the nip is 2 mm, for example. Additionally, the supply roller 42 rotates counterclockwise in FIG. 2 as indicated by an arrow and can transport the toner in the development housing 40 to the outer layer of the developing roller 41 efficiently by rotating in the counter direction to the direction in which the developing roller 41 rotates. Additionally, in the present embodiment, the ratio of rotational frequency of the supply roller 42 to that of the developing roller 41 is 1 so that toner can be supplied reliably.

The doctor blade 43 can be constructed of, for example, a planar metal having a thickness of about 0.1 mm. Steel used stainless (SUS) metal may be used for the doctor blade 43. The doctor blade 43 is disposed so that its end portion (i.e., a free end) contacts the surface of the developing roller 41, forming a regulation nip. The amount of toner carried on the developing roller 41 is adjusted for stable developability and satisfactory image quality. Accordingly, in commercial products, typically the pressure with which the doctor blade 43 contacts the developing roller 41 and the position of the regulation nip are maintained strictly. For example, the contact pressure of the doctor blade 43 against the developing roller 41 is about 20 N/m to 60 N/m, and the regulation nip is positioned about 0.5±0.5 mm from the tip of the doctor blade 43. These parameters can be determined in accordance with properties of developer (toner), the developing roller, and the supply roller. For example, in the present embodiment, the doctor blade 43 is constructed of a SUS metal having a thickness of 0.1 mm, disposed in contact with the developing roller 41 with a pressure of 45 N/m, and the regulation nip is positioned 0.2 mm from the tip of the doctor blade 43. The length from a fixed end of the doctor blade 43 to the free end is 14 mm to form a uniform thin toner layer on the developing roller 41.

Development operation of the above-described developing device 4 is described below with reference to FIG. 2.

When the developing roller 41 and the supply roller 42 start rotating in response to a start command, the supply roller 42 supplies toner to the surface of the developing roller 41. While toner carried on the developing roller 41 passes through a nip between the developing roller 41 and the doctor blade 43, the amount of toner is adjusted. Simultaneously, toner is charged through friction. When toner on the developing roller 41 reaches the position facing the photoreceptor 2 (i.e., a development range), the toner electrostatically moves to the electrostatic latent image formed on the photoreceptor 2, thus developing it into a toner image.

Inside a container body 70 of the toner cartridge 50 serving as the developer container, a developer chamber 51 is formed. Additionally, a discharge opening 52 through which toner is discharged from the developer chamber 51 is formed in the container body 70. The container body 70 further includes a conveying screw 53 and an agitator 54. The agitator 54 agitates toner inside the developer chamber 51, and the conveying screw 53 transports toner inside the developer chamber 51 to the discharge opening 52. The discharge opening 52 is positioned in a lower portion of the developer chamber 51. In the container mounts 106 formed in the partition 108 for mounting the respective toner cartridges 50, supply inlets 49 are formed to connect to the discharge outlets 52 of the respective toner cartridges 50.

The conveying screw 53 includes a rotary shaft 530 and a spiral blade 531 winding around the outer circumference of the rotary shaft 530. The agitator 54 includes a rotary shaft 540 parallel to the rotary shaft 530 of the conveying screw 53 and a deformable planar blade 541 provided to the rotary shaft 540. For example, the blade 541 of the agitator 54 can be formed with a flexible material such as polyethylene terephthalate film. Additionally, when a bottom face 501 of the developer chamber 51 is curved into an arc in conformity with an orbit of rotation of the blade 541 as shown in FIG. 2, the amount of toner that is not moved but remains inside the developer chamber 51 can be reduced.

It is to be noted that, although the toner cartridge 50 can be installed and removed from the apparatus body 100 independently in the present embodiment, it is not essential to aspects of the present invention. For example, the toner cartridge 50 may be united with at least one of the developing device 4, the photoreceptor 2, and the like into a single modular unit to be replaced entirely. Alternatively, the toner cartridge 50 and the developing device 4 may be united into a single development unit to be replaced entirely. In such a configuration, the partition 108 can be omitted and the container mount 106 can be formed not in the partition 108 but in an upper portion of the developing device 4 so that the toner cartridge 50 is directly connected to the upper portion of the developing device 4.

Next, supply of toner to the developing device 4 is described in further detail below.

When the amount of toner inside the development housing 40 falls to or below a reference amount, toner is supplied to the developing device 4. Whether or not the amount of toner is smaller than the reference amount can be determined, for example, based on whether light is permeable between an end of a first light guide 46 and an end of a second light guide 47. When the ends of the first and second light guides 46 and 47 are buried in toner, light is not permeable between them, and thus the amount of toner is deemed equal to or greater than the reference amount. When light permeates between the first and second light guides 46 and 47, it can be deemed that toner is not present therebetween and that the amount of toner is smaller than the reference amount.

When the amount of toner becomes smaller than the reference amount, the conveying screw 53 and the agitator 54 start rotating. As the conveying screw 53 rotates, toner is conveyed to the discharge opening 52 and supplied through the discharge opening 52 to the first compartment E1 inside the development housing 40. As the agitator 54 rotates, toner inside the toner cartridge 50 is agitated and conveyed toward the conveying screw 53. When the amount of toner inside the development housing 40 reaches or exceeds the reference amount, the conveying screw 53 and the agitator 54 are stopped. Thus, toner supply is completed.

Meanwhile, when toner is thus supplied, in the development housing 40, the conveying screws 44 and 45 start rotating and conveying toner in the opposite directions in the first and second compartments E1 and E2, respectively. When toner conveyed by the conveying screws 44 and 45 reaches downstream end portions in the first and second compartments E1 and E2 in the direction which toner is conveyed (hereinafter "toner conveyance direction"), toner is forwarded to the other compartment E1 or E2 through the opening 48*a* formed in the either end portion of the partition 48. Then, toner is conveyed in the compartment E1 or E2 toward the opposite end and returned through the opening 48 to the compartment E1 or E2 where the toner is present originally. By repeating this operation, toner can be circulated between the first compartment E1 and the second compartment E2, and the supplied toner can be mixed with the toner existing in the development housing 40. Thus, the ratio of fresh toner in the existing toner inside the development housing 40 can become uniform, thus inhibiting occurrence of image failure such as color unevenness and toner smear in the background of output images.

Figure 3:
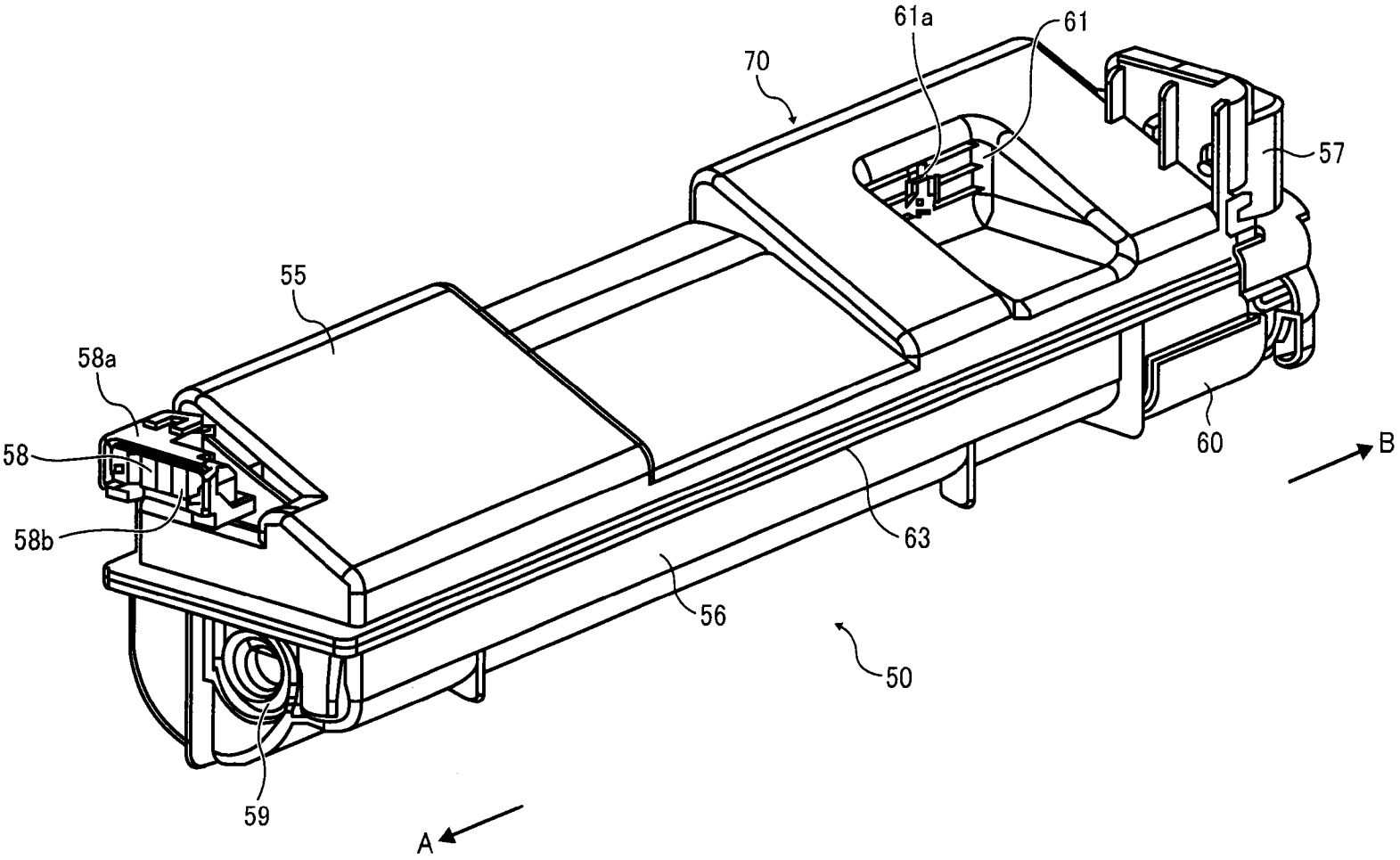
FIG. 3 is a perspective view that illustrates an exterior of the toner cartridge.
Figure 4:
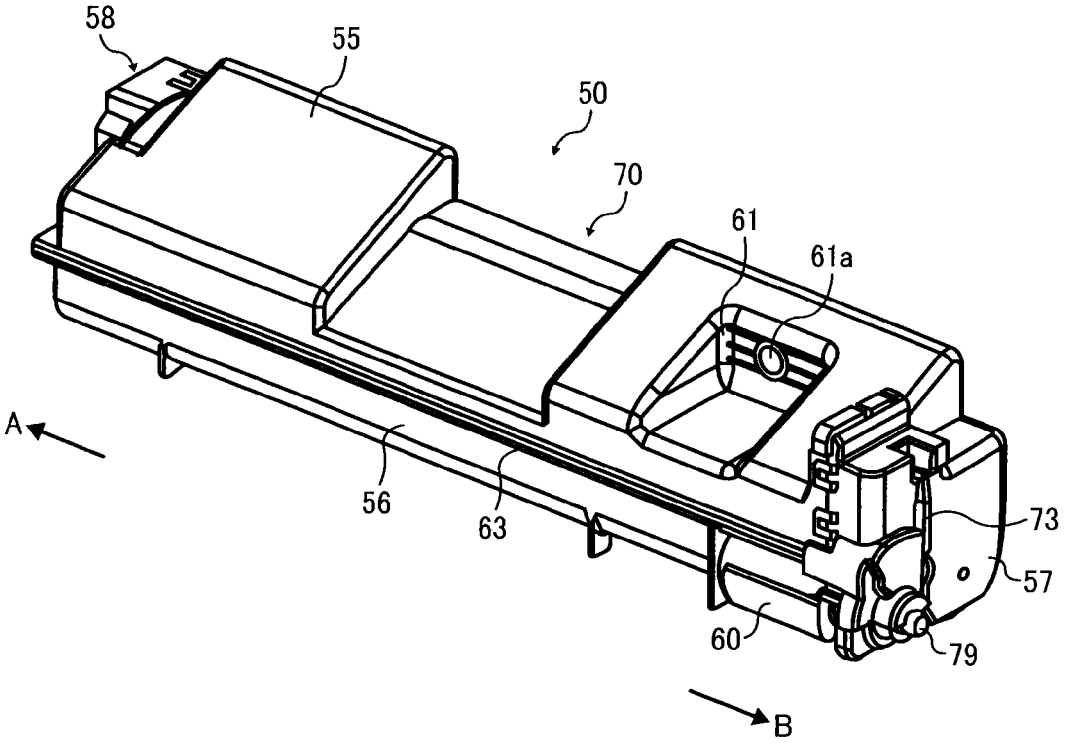
FIG. 4 is a perspective view that illustrates an exterior of the toner cartridge as viewed from a distal side in FIG. 3.

FIGS. 3 and 4 are perspective views of the toner cartridge 50. FIG. 3 illustrates the toner cartridge 50 as viewed from a first end, that is, downstream in the direction indicated by arrow A, and FIG. 4 illustrates the toner cartridge 50 as viewed from a second end, that is, downstream in the direction indicated by arrow B.

As shown in FIGS. 3 and 4, the container body 70 of the toner cartridge 50 includes an upper case 55 and a lower case 56. The toner cartridge 50 further includes a terminal 58 attached to a side face (at the first end) of the container body 70, a gear cover 57 covering the opposite side face (at the second end) of the container body 70, and a shutter 60 disposed in a second end portion of the container body 70 (on the same side as the gear cover 57). A periphery portion of an opening of the upper case 55 and that of the lower case 56 are bonded together, forming the container body 70. The bonded portion serves as a flange 63 that extends over the entire circumference of the container body 70. Toner, the conveying screw 53, and the agitator 54 are contained inside the container body 70. The upper case 55 and the lower case 56 can be welded together employing vibration welding, ultrasonic welding, or the like; or bonded together using double-sided adhesive tape, adhesive, or the like.

It is to be noted that reference numeral 73 in FIG. 4 represents a groove formed in the outer face of the gear cover 57, and 79 represents a projection projecting from the gear cover 57.

Figure 5:
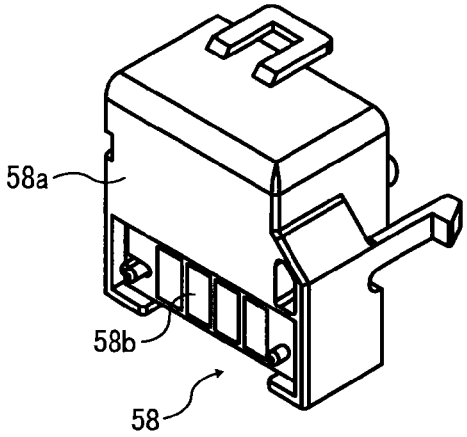
FIG. 5 is a perspective view illustrating a container-side terminal according to an embodiment.

As shown in FIG. 3, the terminal 58 (hereinafter also "container-side terminal 58") is provided to an end face at the first end (hereinafter "first end face") in the longitudinal direction of the container body 70. As shown also in FIG. 5, the terminal 58 includes a holder 58*a* and a single or multiple contacts 58*b* (container-side contacts 58*b*) supported by the holder 58*a*. For example, the number of the contacts 58*b* is four in the configuration shown in FIG. 5. The contacts 58*b* are planar and connected to a data storage element such as integrated circuit (IC) chip. The data storage element can store data, such as the color and the amount of toner, relating to the toner cartridge 50. When each container-side contact 58*b* is brought into contact with a contact 104*b* (shown in FIG. 16, also "apparatus-side contact 104*b*") provided to the apparatus body 100 and electrically connected thereto, the image forming apparatus 1000 can read data relating to the toner cartridge 50 stored in the data storage element, or the data stored in the data storage element can be updated. Additionally, a cap 59 to cap a supply inlet through which toner is supplied to the container body 70 is provided on the first end face of the container body 70. The cap 59 is designed to prevent leakage of toner from the supply inlet after toner is supplied to the toner cartridge 50 through the supply inlet.

The arrangement in which the shutter 60 is disposed in the second end portion whereas the terminal 58 is disposed at the first end away from the shutter 60 is advantageous in that smear of toner on the terminal 58 can be inhibited, thereby enhancing passage of electricity between the container-side terminal 58 and the apparatus-side contact 104*b*.

The gear cover 57 is attached to the second end face at the second end in the long side of the container body 70. Inside the gear cover 57, multiple gears, serving as a torque transmission unit, are provided to transmit driving force from the apparatus body 100 to the conveying screw 53 and the agitator 54.

The shutter 60 for opening and closing the discharge opening 52 is provided in the second end portion of the container body 70. The shutter 60 is rotatable along the outer circumference of the container body 70 that is partly cylindrical. Depending on the direction of rotation of the shutter 60, the discharge opening 52 is opened as shown in FIG. 2 and closed.

The container body 70 further includes a grip 61 (i.e., a gripper or handle) positioned between a center position and the second end in the longitudinal direction of the container body 70. In replacement of the toner cartridge 50, users or operators can install or remove the toner cartridge 50 from the apparatus body 100 easily by gripping the grip 61. An annular rib 61*a* is formed on an inner face of the grip 61 to make the grip 61 more recognizable.

Figure 6:
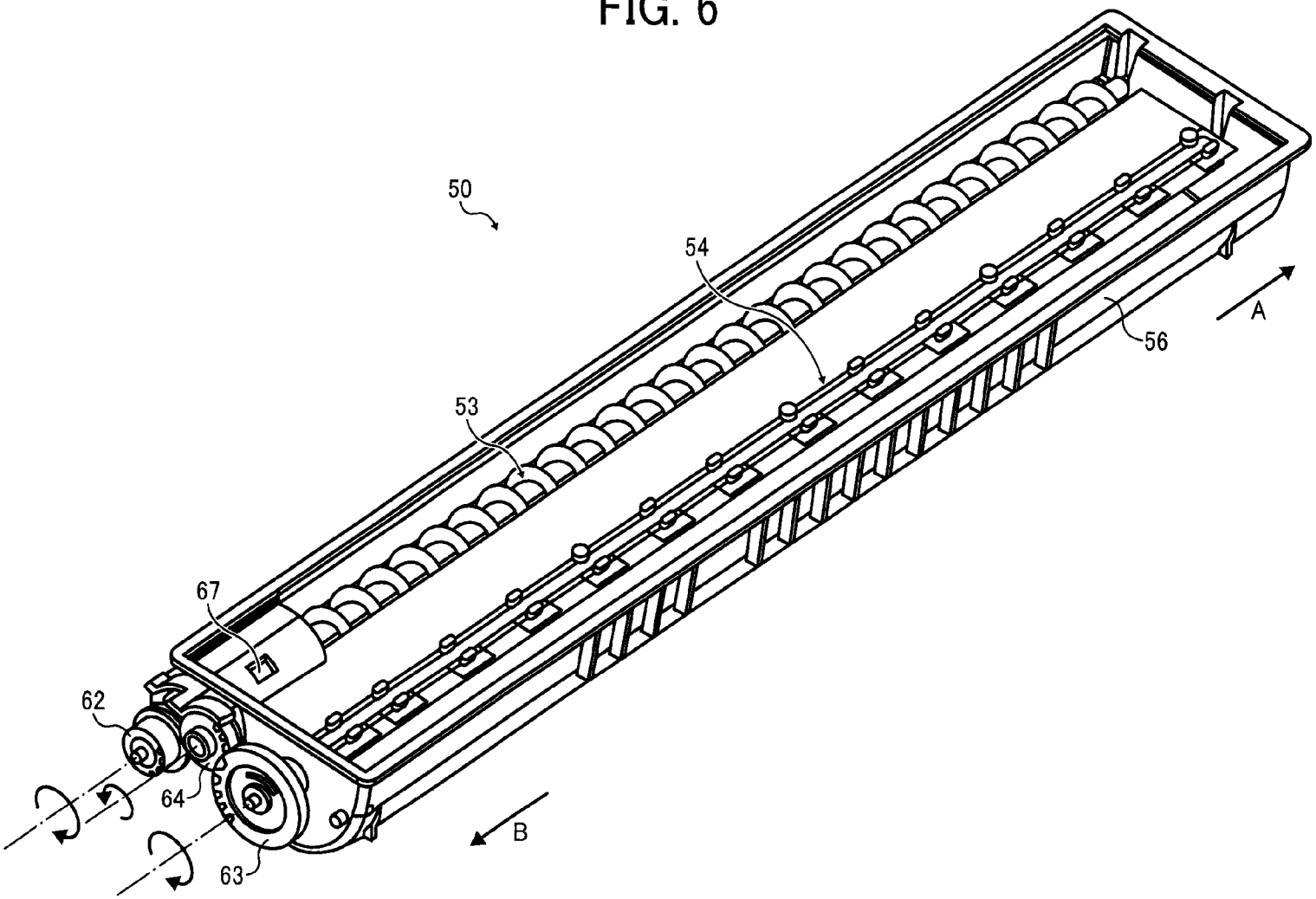
FIG. 6 is a perspective view illustrating the toner cartridge from which an upper case and a gear cover are removed.

FIG. 6 is a perspective view illustrating the toner cartridge 50 from which the upper case 55 and the gear cover 57 are removed.

In FIG. 6, reference numerals 62, 63, and 64 represent the gears contained in the gear cover 57, and reference numeral 67 represents a return opening. The gear 62 (hereinafter also "conveyance driving gear 62") is attached to the rotary shaft 530 (shown in FIG. 2) of the conveying screw 53, and the gear 63 (hereinafter also "agitator driving gear 63") is connected to the rotary shaft 540 of the agitator 54. The rotary shafts 530 and 540 project outside from the side face at the second end (hereinafter "second end face") of the lower case 56. The gear 64 engages the conveyance driving gear 62 as well as the agitator driving gear 63 to transmit a rotation torque and hereinafter also referred to as "torque transmission gear 64".

The apparatus body 100 is provided with a gear 105 (shown in FIGS. 17 and 18, hereinafter also "apparatus-side gear 105"). When the toner cartridge 50 is installed in the container mount 106 of the apparatus body 100, the conveyance driving gear 62 engages the apparatus-side gear 105 provided to the apparatus body 100. When the apparatus-side gear 105 of the apparatus body 100 rotates in this state, the conveyance driving gear 62, the agitator driving gear 63, and the torque transmission gear 64 rotate in the directions indicated by respective arrows shown in FIG. 6, thus rotating the conveying screw 53 and the agitator 54. The conveyance driving gear 62 in the present embodiment can be a double gear including a large-diameter gear and a small-diameter gear. The large-diameter gear meshes with the torque transmission gear 64, whereas the small-diameter gear meshes with the apparatus-side gear 105.

Figure 7:
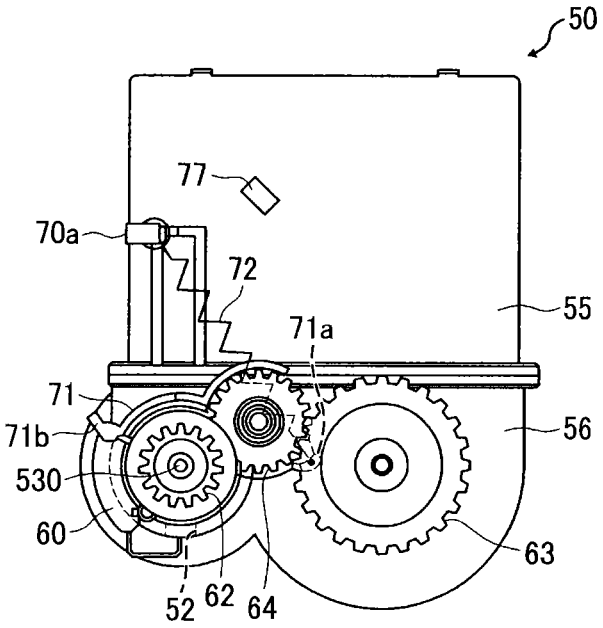
FIG. 7 is a side view that illustrates a state in which the gear cover is removed from the toner cartridge.
Figure 8:
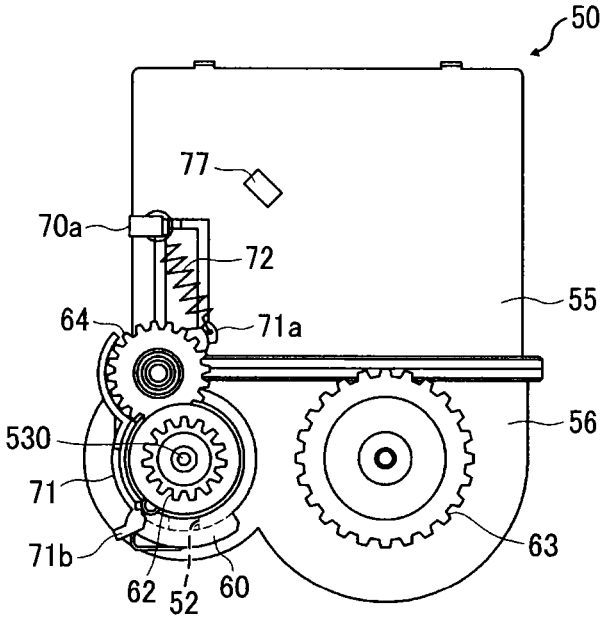
FIG. 8 is another side view that illustrates a state in which the gear cover is removed from the toner cartridge.

FIGS. 7 and 8 are side views that illustrate the toner cartridge 50 from which the gear cover 57 is removed. It is to be noted that reference numeral 77 represents a slot formed in the side face of the upper case 55.

Figure 9:
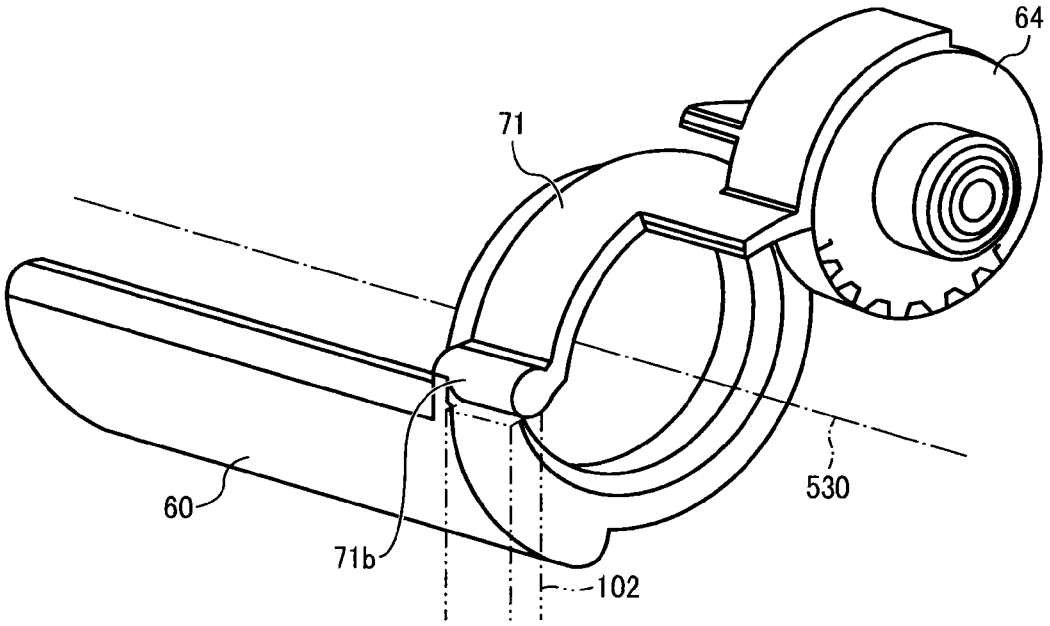
FIG. 9 is a perspective view of the gear cover.

In the present embodiment, the torque transmission gear 64 is movable between an activation position shown in FIG. 7, at which the torque transmission gear 64 meshes with the gears 62 and 63 to transmit torque thereto, and a withdrawn position shown in FIG. 8, disengaged from the gears 62 and 63. Specifically, as shown in FIG. 9, the torque transmission gear 64 is held by a gear holder 71 that is rotatable around the rotary shaft 530 of the conveying screw 53 (or the conveyance driving gear 62). As the gear holder 71 rotates in normal and reverse directions, the position of the torque transmission gear 64 can be switched between the activation position shown in FIG. 7 and the withdrawn position shown in FIG. 8.

As shown in FIG. 9, the shutter 60 (i.e., an external shutter) and the gear holder 71 are formed as a single component. As the gear holder 71 rotates around the rotary shaft 530, the shutter 60 rotates around the rotary shaft 530 similarly. In this case, the discharge opening 52 is opened by the shutter 60 when the torque transmission gear 64 is at the activation position shown in FIG. 7, and the discharge opening 52 is closed by the shutter 60 when the torque transmission gear 64 is at the withdrawn position shown in FIG. 8.

Referring to FIGS. 7 and 8, a tension spring 72 serving as a biasing member is provided between the gear holder 71 and the upper case 55. An end of the tension spring 72 is connected to a latch 71*a* provided to the gear holder 71, and another end of the tension spring 72 is connected to a latch 70*a* provided to the side face of the upper case 55. Biased or pulled by the tension spring 72, the gear holder 71 urges the torque transmission gear 64 to move away from the agitator driving gear 63. Accordingly, when no external force is applied to the gear holder 71, the torque transmission gear 64 moves to the withdrawn position shown in FIG. 8, being pulled by the tension spring 72.

As shown in FIG. 9, the gear holder 71 includes a gear holder protrusion 71*b* that contacts or abuts against an upper end of an apparatus-side protrusion 102 (shown in FIG. 17, serving as a shutter opener) provided in the apparatus body 100 when the toner cartridge 50 is mounted in the container mount 106 of the apparatus body 100. When the toner cartridge 50 is removed from the apparatus body 100, the gear holder protrusion 71*b* is disengaged from the apparatus-side protrusion 102.

Figure 10:
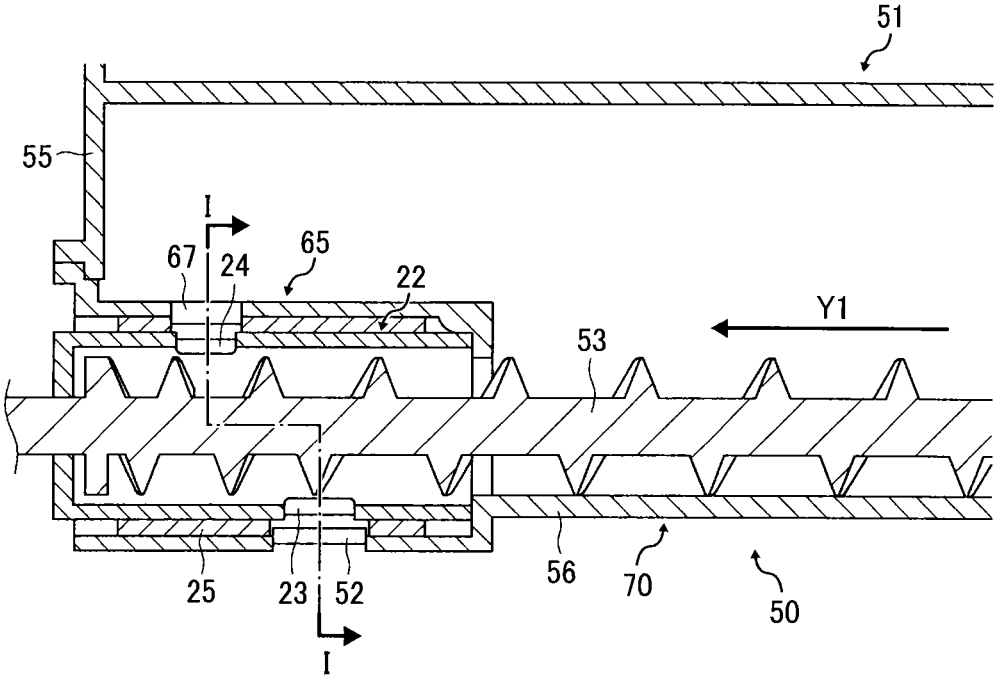
FIG. 10 is a cross-sectional view of the toner cartridge being cut axially at the position of the conveying screw.

FIG. 10 is a cross-sectional view of the toner cartridge 50 being cut at the position of the conveying screw 53. The cross section parallels the axial direction of the toner cartridge 50.

As shown in FIG. 10, in addition to the shutter 60, the toner cartridge 50 further includes another shutter 22, and thus employs a double-shutter structure. The shutters 22 and 60 together form a shutter assembly. The shutter 60 (hereinafter also "external shutter 60") opens and closes the outer side of the discharge opening 52, and the shutter 22 (hereinafter also "internal shutter 22") opens and closes the inner side of the discharge opening 52.

The internal shutter 22 is cylindrical, and a developer outlet 23 is formed in a circumferential wall thereof. As the internal shutter 22 rotates around a center of axis, the position thereof switches between an open position at which the developer outlet 23 overlaps with the discharge opening 52 and a closing position at which the circumference wall of the internal shutter 22 overlaps with the discharge opening 52 with the developer outlet 23 deviated from the discharge opening 52. The conveying screw 53 is inserted in an inner portion in the direction of diameter (i.e., inner diameter portion).

Additionally, a return opening 24 is formed in the internal shutter 22, and toner that is not discharged via the developer outlet 23 through the discharge opening 52 can be returned from inside the internal shutter 22 to the developer chamber 51. The return opening 24 is positioned downstream from the developer outlet 23 in the toner conveyance direction indicated by arrow Y1 shown in FIG. 10.

A half-round or semicylindrical canopy 65 is provided on the outer circumferential side of the internal shutter 22. The internal shutter 22 is held rotatably between the canopy 65 and an inner wall of the container body 70.

It is to be noted that the internal shutter 22 may be rotatably supported without the canopy 65 when one end thereof is cantilevered by the container body 70. Providing the canopy 65 is advantageous in that the inner cylindrical face can serve as a bearing and that the rotational position of the internal shutter 22 can be more stabilized. In the canopy 65, the return opening 67 is formed at a position facing the return opening 24 of the internal shutter 22.

A cylindrical seal member 25 is provided to the clearance between the outer circumferential face of the internal shutter 22 and the canopy 65 and that between the inner circumferential face of the internal shutter 22 and the inner wall of the container body 70 to prevent toner from leaking therethrough.

Figure 11A:
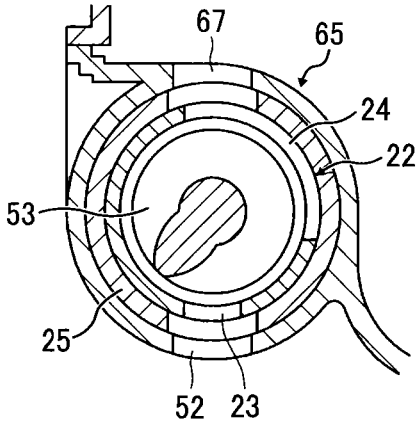
FIG. 11A is a cross-sectional view illustrating an area around a discharge opening that is closed.

FIG. 11A is a cross-sectional view along line I-I in FIG. 10 and illustrates the internal shutter 22 being at the open position and the developer outlet 23 being overlapping with the discharge opening 52. By contrast, in FIG. 11B, the developer outlet 23 is deviated from the discharge opening 52, and the internal shutter 22 is at the closing position.

Figure 11B:
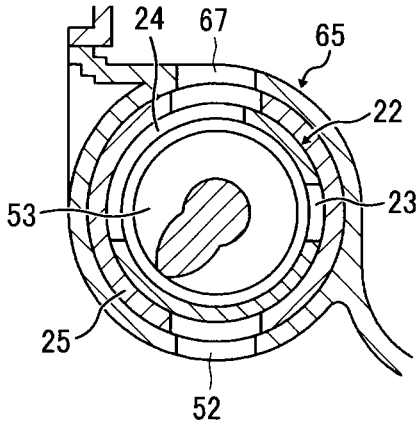
FIG. 11B is a cross-sectional view illustrating the area around the discharge opening that is open.

As shown in FIG. 11A, the return opening 24 formed in the internal shutter 22 extends in the circumferential direction of the internal shutter 22 and longer than the developer outlet 23 in the circumferential direction. With such a configuration of the return opening 24, the return opening 24 can, at least partly, overlap with the return opening 67 of the canopy 65 regardless of whether the internal shutter 22 is at the open position as shown in FIG. 11A or the closing position as shown in FIG. 11B.

Figure 12A:
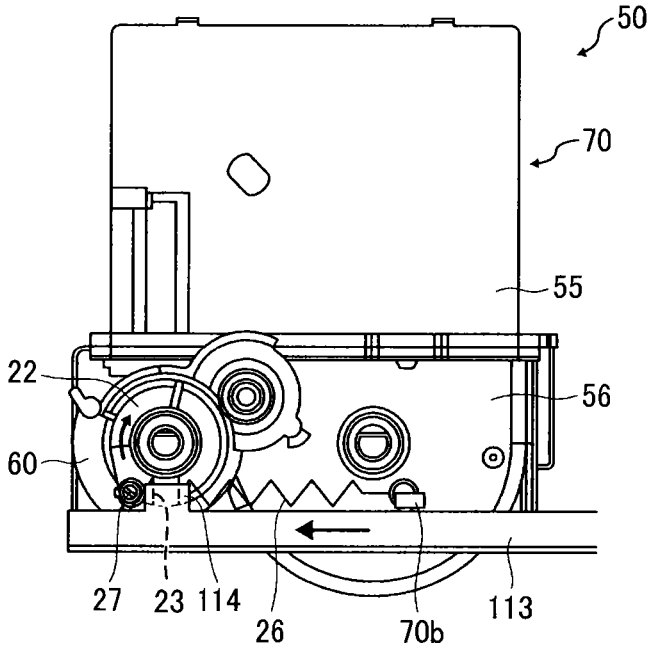
FIG. 12A is a cross-sectional view in which an internal shutter is moved to an open position by a driving assembly.
Figure 12B:
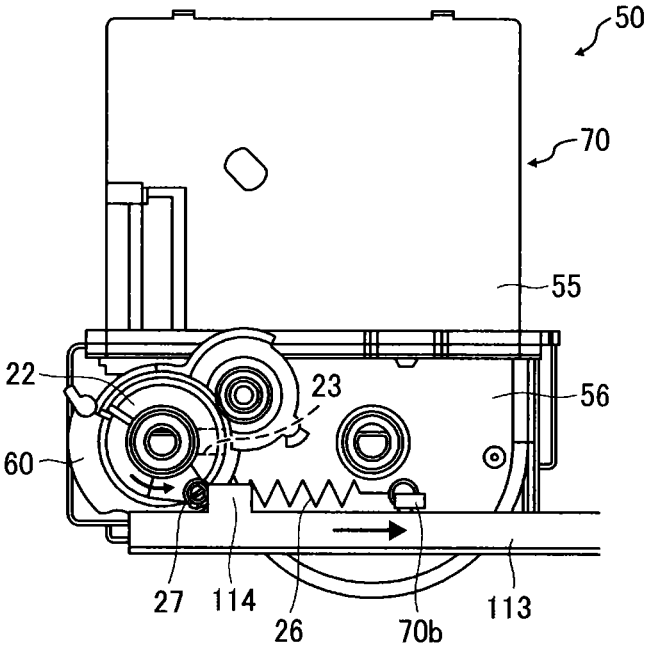
FIG. 12B is a cross-sectional view in which the internal shutter is at a closing position.
Figure 13:
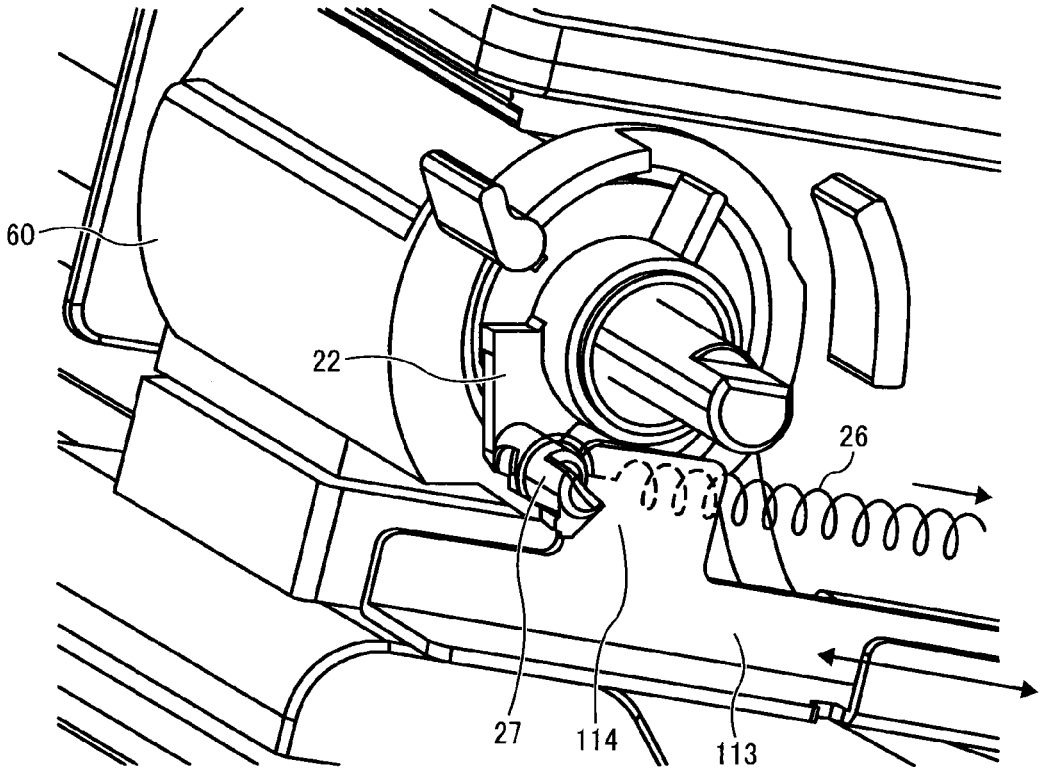
FIG. 13 is a perspective view illustrating the internal shutter and the driving assembly therefore as viewed from outside.

FIG. 12A is a cross-sectional view in which the internal shutter 22 is moved to the open position by a driving assembly, and FIG. 12B is a cross-sectional view in which the internal shutter 22 is at the closing position. FIG. 13 a perspective view illustrating the internal shutter 22 and the driving assembly therefore as viewed from outside. It is to be noted that the gear cover 57 and the gears, such as the conveyance driving gear 62, are removed from the toner cartridge 50 in FIGS. 12A, 12B, and 13.

As shown in FIGS. 12A, 12B, and 13, the driving assembly to drive the internal shutter 22 includes a tension spring 26 to urge the internal shutter 22, a projection 27 of the internal shutter 22, and a movable member 113 that is movable horizontally and provided to the apparatus body 100.

The projection 27 is formed at an end of the internal shutter 22 exposed from the lower case 56 and projects in the axial direction of the internal shutter 22. The tension spring 26 is attached to the projection 27 and an engagement portion formed on the side face of the lower case 56 and extends therebetween.

The movable member 113 extends long horizontally and supported movably in the horizontal direction inside the apparatus body 100. The apparatus body 100 includes a driving unit to cause the movable member 113 to reciprocate horizontally. As the driving unit for the movable member 113, a solenoid or cam mechanism is advantageous in that fluctuations in the amount of movement can be smaller. The movable member 113 includes projections 114 to abut against the projections 27 of the respective toner cartridges 50. That is, the number of the projections 114 is identical to that of the toner cartridges 50.

Referring to FIGS. 12A and 12B, descriptions are given below of movement of the internal shutter 22 for opening and closing the discharge opening 52.

As the movable member 113 moves to the left in FIGS. 12A and 12B, the projection 114 of the movable member 113 presses the projection 27 of the internal shutter 22 against the bias force exerted by the tension spring 26, and the internal shutter 22 rotates clockwise in these figures. Accordingly, the developer outlet 23 faces down in FIGS. 12A and 12B, and the discharge opening 52 is open as shown in FIG. 11A.

By contrast, referring to FIG. 12B, as the movable member 113 moves to the right in these figures, the force pressing the projection 27 is canceled, and the internal shutter 22 rotates counterclockwise in these figures, urged by the tension spring 26. Accordingly, the developer outlet 23 faces to the right in FIG. 12B, and the discharge opening 52 is closed as shown in FIG. 11B.

Figure 14:
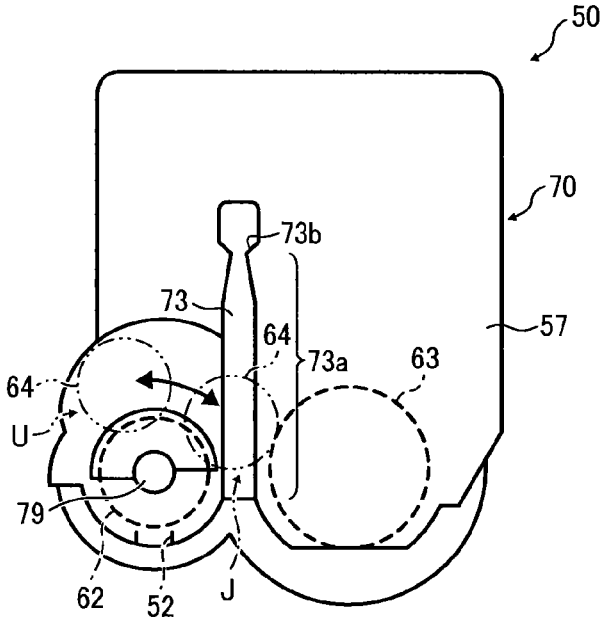
FIG. 14 is a side view of the toner cartridge as viewed from the side of the gear cover.

FIG. 14 is a side view of the toner cartridge 50 as viewed from the side of the gear cover 57.

As shown in FIG. 14, the groove 73 extending vertically in FIG. 14 is formed in the outer face of the gear cover 57 (also shown in FIG. 4). The groove 73 have capabilities of guiding the direction of installation of the container body 70 and determining the position of the container body 70 relative to the apparatus body 100 in cooperation with a projection 101 (shown in FIG. 17) of the apparatus body 100 when the toner cartridge 50 is mounted in the apparatus body 100. Specifically, the groove 73 includes a guide portion 73*a* extending from the lower end of the groove 73 and a positioning portion 73*b* positioned above the guide portion 73*a* in FIG. 14. The positioning portion 73*b* is reduced in width, which is a lateral length in FIG. 14, from the guide portion 73*a*. The lower end of the guide portion 73*a* is open. The width of the guide portion 73*a* is constant except an upper end portion in which the width decreases progressively toward the positioning portion 73*b* in FIG. 14.

Additionally, the projection 79 projecting from the outer side of the gear cover 57 can serve as another guide and positioning portion relative to the apparatus body 100. The outer circumferential surface of the projection 79 is cylindrical. The projection 79 have capabilities of guiding the container body 70 vertically and determining the position of the container body 70 relative to the apparatus body 100 in cooperation with a guide groove 103 (shown in FIG. 17) formed in the apparatus body 100. Thus, in the present embodiment, the position of the container body 70 relative to the apparatus body 100 can be determined at two positions by the positioning portion 73*b* of the groove 73 shown in FIGS. 12A and 12B and the projection 79.

On the back side of the gear cover 57, in particular, on the back side of the positioning portion 73*b*, a positioning boss projects inward. The positioning boss fits in the slot 77 (shown in FIG. 7) formed in the side face of the upper case 55 when the gear cover 57 is attached to the upper and lower cases 55 and 56. Thus, the gear cover 57 can be set in position relative to the upper case 55.

Further, a hole 78 coaxial with the projection 79 is formed on the back side of the gear cover 57. One end of the rotary shaft 530 projecting from the lower case 56 is inserted into the hole 78. As the rotary shaft 530 of the conveying screw 53 is supported by the hole 79, the position of the gear cover 57 can be determined relative to the lower case 56.

In FIG. 14, broken circles represent projection areas in which the gears 62, 63, and 64 are projected on the outer face of the gear cover 57 in which the groove 73 is formed, reference character J represents a projection area of the transmission gear 64 being at the activation position, and reference character U represents a projection area of the torque transmission gear 64 being at the withdrawn position. Thus, in the present embodiment, a part of the guide portion 73*a* of the groove 73 is disposed inside the projection area J of the transmission gear 64 being at the activation position. It is to be noted that, alternatively, the entire guide portion 73*a* may be disposed inside the projection area J of the transmission gear 64 being at the activation position. By contrast, the positioning portion 73*b* whose width is smaller than the guide portion 73*a* is preferably disposed outside the projection area J of the transmission gear 64 being at the activation position.

Next, the base 107 provided in the apparatus body 100 is described below.

Figure 15:
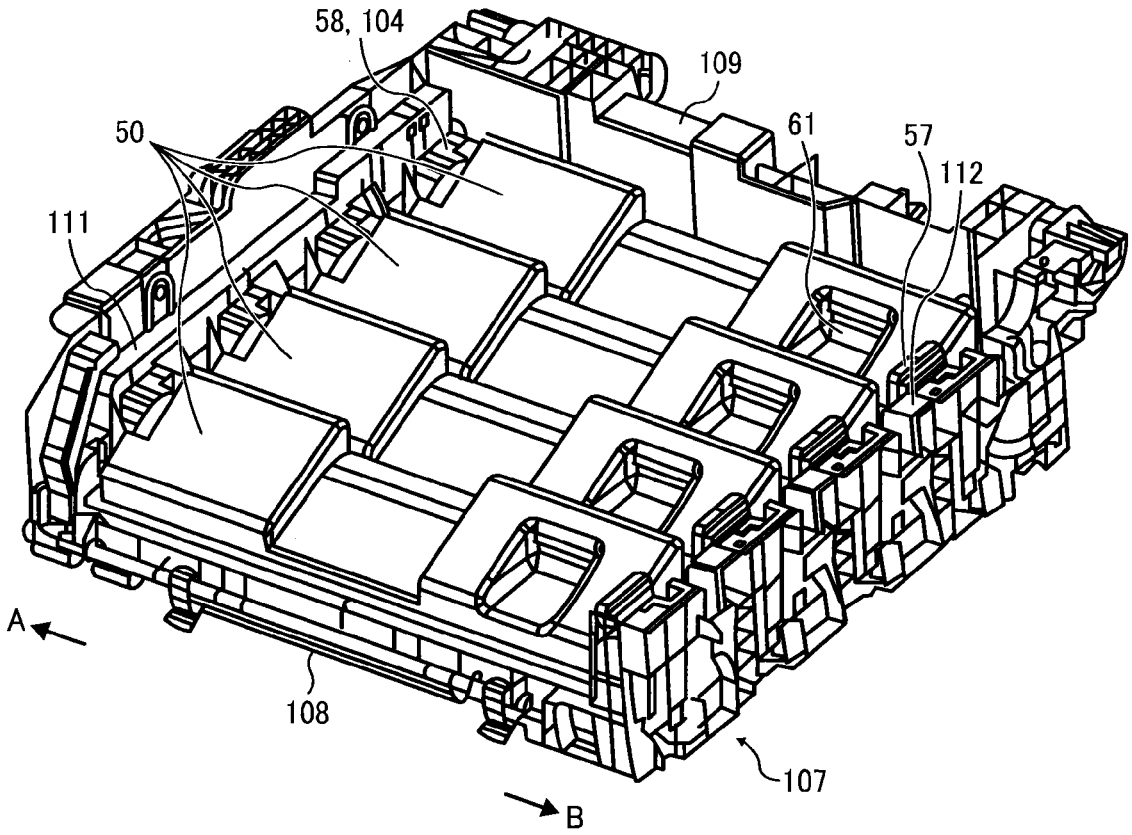
FIG. 15 is a perspective view of a base member according to an embodiment, on which the toner cartridge is mounted.

As shown in FIG. 15, the base 107 includes the partition 108 (shown in FIG. 1) that is substantially rectangular, a back wall 109 provided to a side of the partition 108, and side walls 111 and 112 respectively provided to two sides of the partition 108 with the back wall 109 interposed therebetween. The partition 108 forms a bottom of the base 107. The multiple toner cartridges 50 are disposed between the side walls 111 and 112 horizontally and parallel to each other, and the side faces thereof face the side walls 111 and 112. In the description below, the side wall 111 facing the first end face (with the container-side terminal 58) of the toner cartridge 50 is referred to as "first side wall 111", and the side wall 112 facing the second end face (with the gear cover 57) of the toner cartridge 50 is referred to as "second side wall 112".

Referring to FIG. 1, the toner cartridges 50 inserted between the first and second side walls 111 and 112 are mounted in the container mounts 106 formed in the partition 108. The number of the container mounts 106 is identical to the number of the toner cartridges 50, and each toner cartridge 50 is mounted in the container mount 106 at the position specific to that color.

Figure 16:
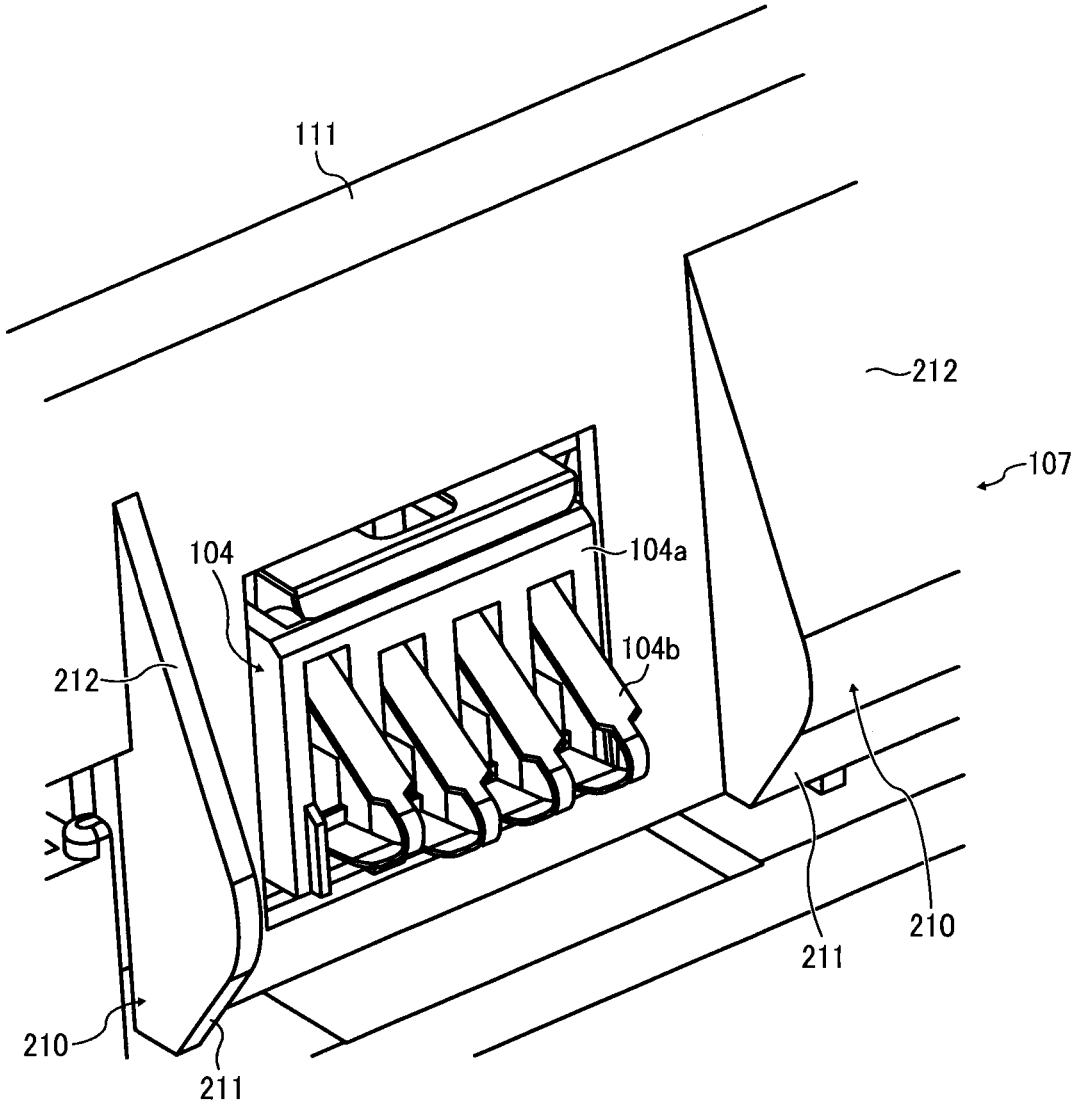
FIG. 16 is a perspective view of a first side wall provided with the apparatus-side terminal and a projection according to an embodiment.

As shown in FIG. 15, four apparatus-side terminals 104 are attached to the first side wall 111 to face the container-side terminals 58 of the respective toner cartridges 50. A configuration of the apparatus-side terminal 104 is shown in FIG. 16. As shown in FIG. 16, each apparatus-side terminal 104 includes a holder 104*a* embedded in the first side wall 111 and the single or multiple apparatus-side contacts 104*b* held by the holder 104*a*. One end (for example, an upper end) of the apparatus-side contact 104*b* is fixed to the holder 104*a*, and the other end (for, example, a lower end) thereof is free. An intermediate portion of the apparatus-side contact 104*b* is shaped into an arc projecting to the inner side of the apparatus body 100, and an apex thereof projects to the inner side of the apparatus body 100 beyond an end face of the holder 104*a*.

Figure 17:
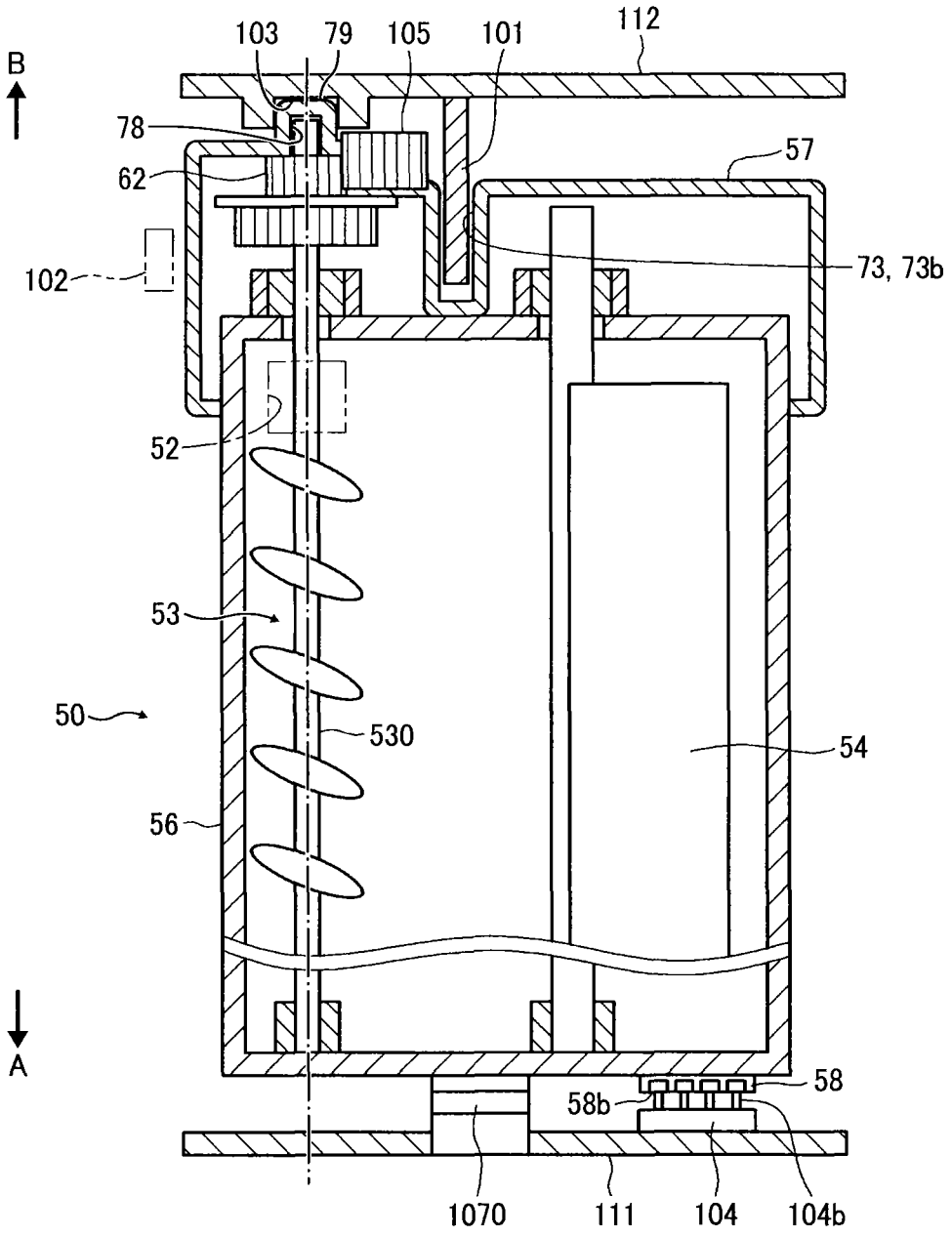
FIG. 17 is a cross-sectional view of the toner cartridge mounted in the apparatus body, as viewed from the bottom.

FIG. 17 is a cross-sectional view of the toner cartridge 50 mounted in the container mount 106, as viewed from the bottom.

As shown in FIG. 17, the projection 101 projecting horizontally is provided to the inner side of the second side wall 112 for each container mount 106. The projection 101 is fitted in the groove 73 (shown in FIG. 4) formed in the gear cover 57 when the toner cartridge 50 is mounted in the apparatus body 100.

Additionally, the guide groove 103 extending vertically is formed on the inner side of the second side wall 112 for each container mount 106. The guide groove 103 is open at its upper end, and the projection 79 of the toner cartridge 50 is inserted from the open end of the guide groove 103 when the toner cartridge 50 is installed. A receiving portion to receive the projection 79 is formed at the lower end of the guide groove 103.

The apparatus-side gear 105 is provided adjacent to the lower end of the guide groove 103. The apparatus-side gear 105 is driven by a driving source provided to the apparatus body 100. In a state in which the toner cartridge 50 is installed in the apparatus body 100, the apparatus-side gear 105 meshes with the conveyance driving gear 62 (shown in FIG. 7).

As shown in FIG. 17, a biasing member 1070 is provided to the first side wall 111 for each container mount 106 to urge the toner cartridge 50 in the direction indicated by arrow B, that is, to the opposite side. For example, the biasing member 1070 can be a leaf spring or the like. The toner cartridge 50 is pressed by the biasing member 1070 against the second side wall 112, and then the end of the projection 79 at the other side abuts against the bottom of the guide groove 103. With this configuration, movement of the toner cartridge 50 in the longitudinal direction thereof (i.e., vertical direction in FIG. 17) can be regulated, and the projection 79 and the projection 101 can be inhibited from being disengaged from the guide groove 103 and the positioning portion 73*b*, respectively.

Figure 18A:
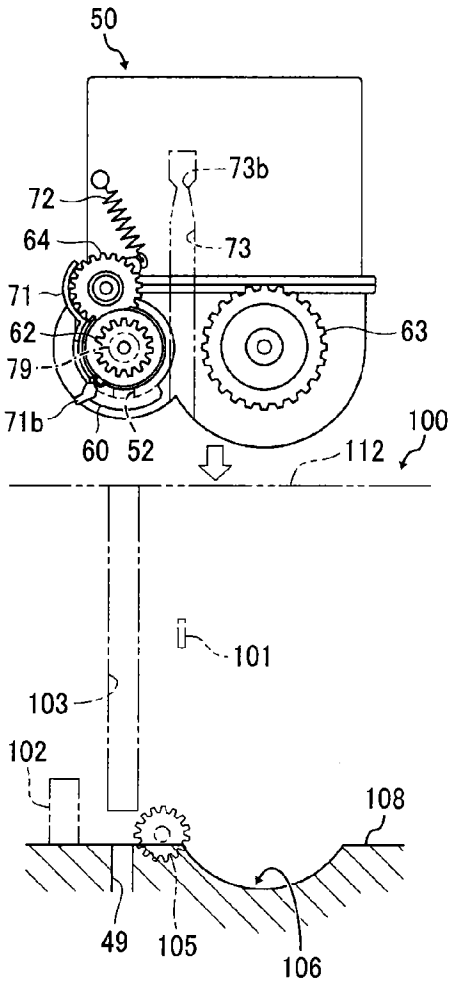
FIGS. 18A, 18B, and 18C illustrate installation and removal of the toner cartridge from the apparatus body according to an embodiment.
Figure 18B:
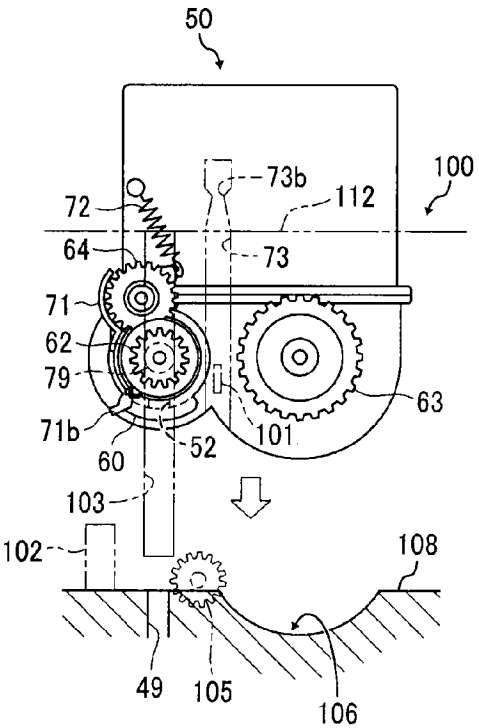
Figure 18C:
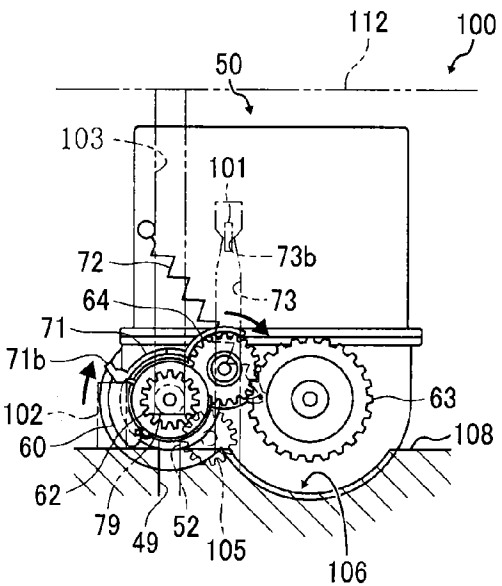

Referring to FIGS. 18A through 18C, installation of the toner cartridge 50 according to the present embodiment into the apparatus body 100 is described below.

To install the toner cartridge 50 into the apparatus body 100, initially the operator lifts the upper cover 109 (shown in FIG. 1), thereby opening the upper side of the apparatus body 100 as indicated by chain double-dashed lines. Subsequently, the operator grips the grip 61 (shown in FIG. 4) and moves down (hereinafter "installation direction") the toner cartridge 50 from the opened upper side of the apparatus body 100 as shown in FIG. 18A.

As the toner cartridge 50 is thus moved, the projection 79 of the toner cartridge 50 enters the upper end of the guide groove 103 of the second side wall 112. During the installation, the guide groove 103 can guide the direction of installation of the toner cartridge 50, and thus the toner cartridge 50 can be smoothly guided to the container mount 106.

In the state in which the toner cartridge 50 is mounted in the container mount 106 as shown in FIG. 18C, the projection 79 of the toner cartridge 50 abuts against the lower end (receiving portion) of the guide groove 103, thus determining the position of the toner cartridge 50.

Additionally, as the toner cartridge 50 is installed, the projection 101 of the second side wall 112 is inserted in the groove 73. As shown in FIG. 18C, when the toner cartridge 50 is mounted in the container mount 106, the projection 101 is positioned at the positioning portion 73*b*, which is a part of the groove 73 and reduced in width from other areas of the groove 73.

During installation of the toner cartridge 50, additionally the apparatus-side protrusion 102 of the apparatus body 100 abuts against the gear holder protrusion 71*b* of the gear holder 71. Then, the gear holder 71 rotates in the direction indicated by arrow shown in FIG. 18C against the bias force exerted by the tension spring 72, and the torque transmission gear 64 is positioned at the activation position to mesh with the agitator driving gear 63. Further, as the gear holder 71 rotates, the external shutter 60 integrated with the gear holder 71 rotates, and thus the outer circumferential side of the discharge opening 52 is opened. The internal shutter 22, however, is closed even in this state, that is, in the state in which the toner cartridge 50 is installed. During a sequence of movements of the external shutter 60 for opening the discharge opening 52, there is a moment when the discharge opening 52 of the toner cartridge 50 is disconnected from the supply inlet 49 formed in the apparatus body 100. Since the internal shutter 22 is closed at that time, leak of toner can be inhibited.

It is to be noted that, when the torque transmission gear 64 is close to the groove 73 while moving to the activation position, the projection 101 has already passed through the range above the activation position, and the torque transmission gear 64 does not interfere with the projection 101.

When the torque transmission gear 64 being at the activation position meshes with the agitator driving gear 63, the conveying screw 53 and the agitator 54 inside the toner cartridge 50 can be connected together to be geared to each other. Simultaneously, the external shutter 60 integrated with the gear holder 71 rotates from the position shown in FIG. 18B to the position shown in FIG. 18C, and the discharge opening 52 is opened. The opened discharge opening 52 is connected to the supply inlet 49 of the apparatus body 100.

Then, the internal shutter 22 moves to the open position. Specifically, triggered by closing of the upper cover 109, the driving unit, such as a solenoid or cam mechanism, to drive the movable member 113, moves the movable member 113. Specifically, for example, when the image forming apparatus 1000 is powered on, the movable member 113 moves to the left in FIG. 12A, thus moving the internal shutter 22 to the open position. Then, both the internal shutter 22 and the external shutter 60 are at the respective open positions, enabling discharge of toner through the discharge opening 52.

Additionally, in the state in which the toner cartridge 50 is mounted in the container mount 106, as shown in FIG. 18C, the conveyance driving gear 62 meshes with the apparatus-side gear 105. When the apparatus-side gear 105 is rotated by a driving source in this state, the driving force is transmitted via the conveyance driving gear 62, the torque transmission gear 64, and the agitator driving gear 63 to the conveying screw 53 and the agitator 54, conveying screw 53 and the agitator 54. With this operation, toner can be supplied from the discharge opening 52 via the supply inlet 49 to the developing device 4.

To remove the toner cartridge 50 from the apparatus body 100, also the operator opens the upper cover 109 (shown in FIG. 1). The driving unit for the movable member 113 is activated in conjunction with this movement. Accordingly, the movable member 113 moves to the right in FIG. 12B, and the internal shutter 22 is closed as shown in that drawing. Then, the operator grips the grip 61 (shown in FIG. 4), moves the toner cartridge 50 upward (hereinafter "removal direction") from the container mount 106, and removes the toner cartridge 50 through the opened upper side of the apparatus body 100.

As shown in FIG. 16B, when the toner cartridge 50 is lifted, the gear holder protrusion 71*b* of the gear holder 71 is disengaged from the apparatus-side protrusion 102 of the apparatus body 100, and the gear holder 71 rotates to the original position, pulled by the tension spring 72. As the gear holder 71 rotates, the torque transmission gear 64 is moved to the withdrawn position disengaged from the agitator driving gear 63. It is to be noted that, although at that time the projection 101 passes through the range overlapping with the activation position above the groove 73, the projection 101 does not interfere with the torque transmission gear 64 because the torque transmission gear 64 has withdrawn from the range above the groove 73 when the projection 101 reaches that range.

Additionally, as shown in FIG. 16B, when the gear holder 71 rotates to the original position, the external shutter 60 also rotates to the position to close the discharge opening 52. Thus, the external shutter 60 can cover the internal shutter 22 whose surface tends to be smeared with toner resulting from connection to the supply inlet 49. Consequently, even if the operator touches the shutter assembly, the possibility of toner smear on hands of the operator can be reduced. Both the shutters 22 and 60 are closed, which is advantageous in preventing scattering of toner from the discharge opening 52.

In the present embodiment, when the toner cartridge 50 is removed from the apparatus body 100, connection between the conveying screw 53 and the agitator 54 inside the toner cartridge 50 is canceled. Accordingly, even if the operator unintentionally touches the gear 62 or 64, thereby driving one of them, the drive force is not transmitted to the other. This configuration can alleviate stress on toner caused when both the conveying screw 53 and the agitator 54 are driven, thus alleviating degradation of toner and damage to the conveying screw 53, the agitator 54, or both.

Even if the operator drives the conveying screw 53, developer (toner) can be returned through the return opening 24 to the developer chamber 51. Accordingly, stress on developer can be alleviated.

Additionally, since the internal shutter 22 is opened after the toner cartridge 50 is fully installed, scattering of toner can be inhibited better. Specifically, although the external shutter 60 is opened in conjunction with installation of the toner cartridge 50, that is, before completion of installation, the closed internal shutter 22 can prevent leak of toner from inside the toner cartridge 50 before the discharge opening 52 is connected to the supply inlet 49. It is to be noted that, to prevent interference between the external shutter 60 and the supply inlet 49 at the time of installation of the toner cartridge 50, the external shutter 60 is opened before completion of installation.

Additionally, in removal of the toner cartridge 50, the internal shutter 22 is closed while the toner cartridge 50 is still installed. Then, the external shutter 60 is closed in conjunction with the toner cartridge 50 moving in the removal direction. Accordingly, even if toner adheres to the inner side of the discharge opening 52, toner can be inhibited from scattering. Thus, in the present embodiment, the double-shutter structure including the internal shutter 22 and the external shutter 60 can enhance the effect of inhibiting toner scattering from the discharge opening 52 during installation and removal of the toner cartridge 50.

Additionally, since the external shutter 60 can automatically close the discharge opening 52 in conjunction with removal of the toner cartridge 50, this configuration can eliminate the possibility of leaving the discharge opening 52 open and consequent toner leak or scattering.

Descriptions are given below of a configuration to inhibit collision between the toner cartridge 50 and the apparatus body 100 (in particular, apparatus-side terminal 58) in installation and removal of the toner cartridge 50.

Figure 19A:
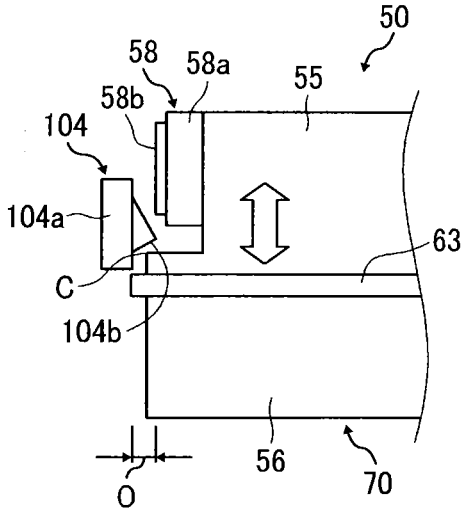
FIG. 19A is a front view of a first end portion of the toner cartridge.

In the present embodiment, as described above, each contact 104*b* of the apparatus-side terminal 104 has a shape projecting to the inner side of the apparatus body 100 beyond the end face of the holder 104*a* such that the contact 104*b* can elastically contact the planar contact 58*b* of the container-side terminal 58. Usually, the toner cartridge 50 is lifted when removed from the apparatus body 100, and, as shown in FIG. 19A, there can be a risk that the container body 70 hits the contacts 104*b* of the apparatus-side terminal 104, deforming or damaging it. The possibility of collision of the container body 70 with the apparatus-side contact 104*b* is higher at a corner C (i.e., an upper corner) of the upper case 55 vertically above the flange 63 formed at the joint between the upper and lower cases 55 and 56.

Figure 19B:
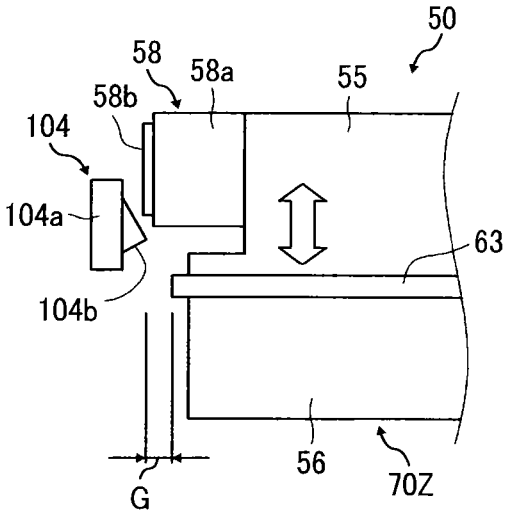
FIG. 19B is a front view of a first end portion of a comparative toner cartridge

FIG. 19B illustrates a comparative example in which the length of a container body 70Z is reduced from that in FIG. 19A, thereby securing a clearance G between the flange 63 of the container body 70Z and the apparatus-side contact 104*b* to avoid such collision. In the example shown in FIG. 19B, however, the capacity of the container body 70Z is reduced, which may impose a disadvantage on compactness of the image forming apparatus.

Figure 20:
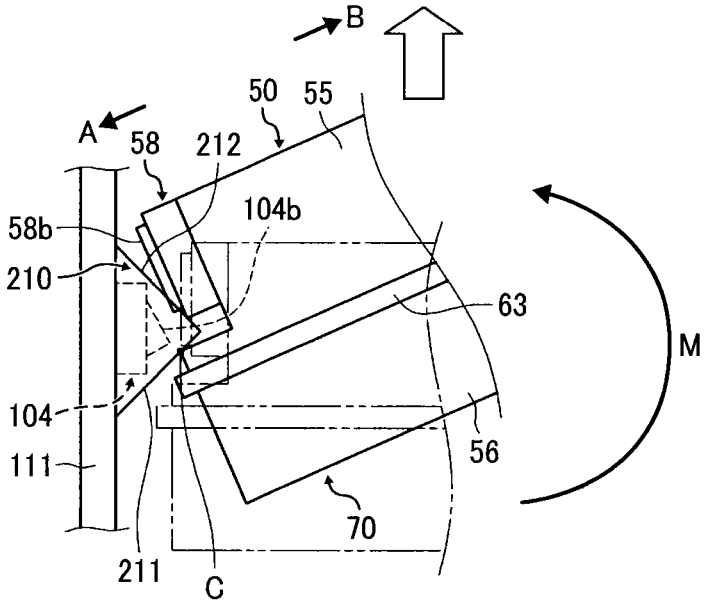
FIG. 20 is a front view of the first end portion of the toner cartridge being removed.
Figure 21:
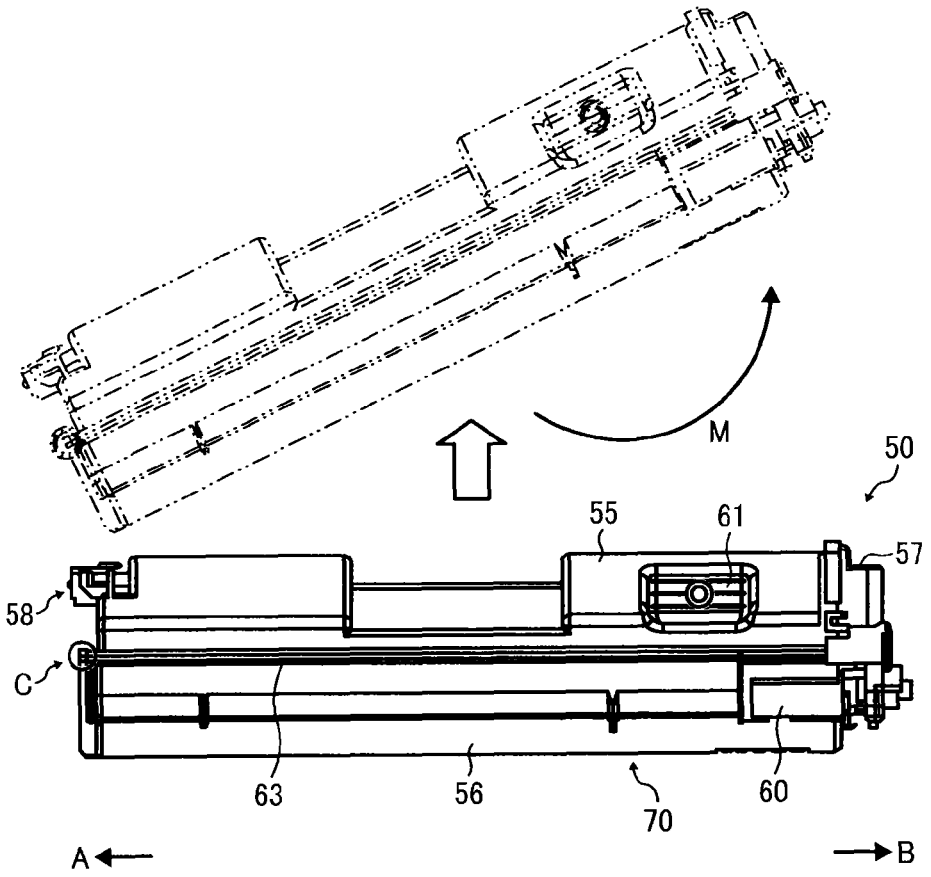
FIG. 21 is a front view of the toner cartridge being removed.

By contrast, FIGS. 20 and 21 illustrate the configuration according to the present embodiment to prevent the collision. Specifically, in removal of the toner cartridge 50, the second end (downstream side in the direction B) of the toner cartridge 50 is lifted before the first end is lifted. That is, in removal, the second end of the toner cartridge 50 is disengaged from the apparatus body 100 before the first end thereof is disengaged from the apparatus body 100. This can be achieved when, for example, a rotation moment M shown in FIGS. 20 and 21 is given to the toner cartridge 50 to cause the toner cartridge 50 to pivot around the first end. With such rotation of the toner cartridge 50, the second end thereof is released from the container mount 106, after which the first end thereof moves up while sliding to the second end.

With this configuration, the toner cartridge 50 can be lifted while the first end thereof is moved away from the area vertically below the apparatus-side terminal 104 toward the inner side of the apparatus body 100. Accordingly, even in configurations in which the clearance G shown in FIG. 19B is smaller or, more extremely, is minus, the container body 70 can be free from contact with the apparatus-side contact 104*b* during removal from the apparatus body 100. With this configuration, the capacity of the container body 70 can be increased, thereby reducing the size of the image forming apparatus 1000.

Referring to FIG. 20, in the present embodiment, the rotation of the toner cartridge 50 can be achieved by projections 210, serving as apparatus-side protrusions, projecting from the first side wall 111 to the inner side of the apparatus body 100. In the configuration shown in FIG. 20, the projections 210 are tapered and triangular in cross section. That is, the width thereof (lateral length in FIG. 20) decreases from an intermediate portion to the upper and lower ends.

As shown in FIG. 16, the two projections 210 are positioned across the apparatus-side terminal 104 in the lateral direction. Each container mount 106 is provided with the two projections 210 disposed across the apparatus-side terminal 104 in the lateral direction.

As shown in FIG. 20, each projection 210 is disengaged from the container body 70 in the state in which the toner cartridge 50 is mounted in the container mount 106. When removal of the toner cartridge 50 is started in this state, a portion out of the entire container body 70 abuts against the projection 210 immediately after the start of removal. Specifically, the portion overlapping with the projection 210 in the longitudinal direction abuts against the projection 210, which in the present embodiment is the upper corner C (or stepped portion C) and hereinafter also referred to as "contact portion C".

After the contact portion C of the container body 70 contacts the projection 210, the rotation moment M is exerted on the toner cartridge 50 as the toner cartridge 50 is moved further in the removal direction. Accordingly, while rotating in that direction, the toner cartridge 50 leaves the container mount 106. Since the toner cartridge 50 can be lifted while the first end thereof is shifted to the side of the second end (hereinafter "second-end side", the collision between the container body 70 and the apparatus-side contact 104*b* can be avoided during removal of the toner cartridge 50.

During removal of the toner cartridge 50, a lower face 211 of the projection 210 contacts the container body 70, thus guiding removal of the toner cartridge 50 (hereinafter "removal guide face 211"). In the configuration shown in FIG. 20, the lower side of the projection 210 is tapered such that the removal guide face 211 is inclined to the inner side of the apparatus body 100 as the position ascends. With this configuration, after contacting the removal guide face 211, the toner cartridge 50 can be guided by the removal guide face 211 in the direction B to the second-end side in the longitudinal direction as the toner cartridge 50 is moved further in the removal direction. Therefore, removal of the toner cartridge 50 can be smooth without a holdup.

Figure 22:
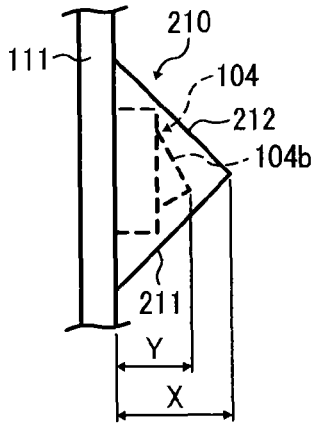
FIG. 22 is a front view that schematically illustrates a projection provided to the apparatus body.

In this configuration, the contact 104*b* of the apparatus-side terminal 104 is disposed inside an area in which the projection 210 is projected on a plane (parallel to the surface of the paper on which FIG. 20 is drawn) that includes a trajectory of the toner cartridge 50 being removed. In this case, as shown in FIG. 22, a maximum distance X of the removal guide face 211 from the inner face of the first side wall 111 is greater than a maximum projecting length Y of the contact 104*b* of the apparatus-side terminal 104 (X>Y). This configuration can secure prevention of collision between the container body 70 and the contact 104*b* of the apparatus-side terminal 104.

As described above, in the present embodiment, the grip 61 that the operator grips in installation and removal of the toner cartridge 50 is shifted to the second end from the longitudinal center in the direction B as shown in FIG. 21. With this arrangement, when the operator exerts upward force on the toner cartridge 50 in removal thereof, the rotation moment M can be applied to the toner cartridge 50 without the operator's attention. This can foster the rotation of the toner cartridge 50, thus facilitating removal of the toner cartridge 50.

As shown in FIG. 20, the upper side of the projection 210 is tapered such that an upper face 212 is inclined to the inner side of the apparatus body 100 as the position descends. During installation of the toner cartridge 50, the upper face 212 of the projection 210 contacts the container body 70, thus guiding installation of the toner cartridge 50 (hereinafter "installation guide face 212"). When the contact 104*b* of the apparatus-side terminal 104 is disposed within the projection area of the projection 210 including the installation guide face 212, the collision between the container body 70 and the apparatus-side contact 104*b* can be prevented also in installation of the toner cartridge 50. In installation of the toner cartridge 50, when the container body 70 contacts the installation guide face 212, the toner cartridge 50 can be guided in the direction B to the second-end side, thus attaining smooth installation of the toner cartridge 50.

Figure 24:
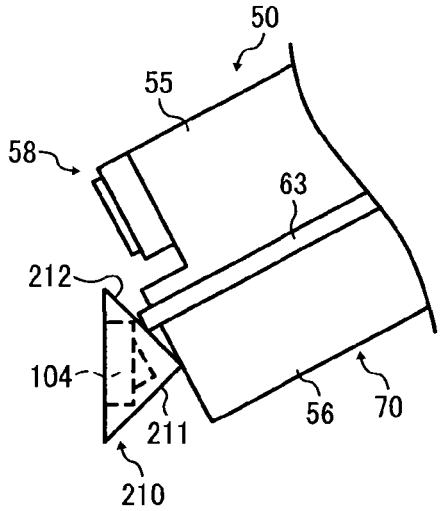
FIG. 24 is a front view of the first end portion of the toner cartridge being installed.

In the configuration shown in FIG. 19A, in which the container body 70 is relatively long such that the first end thereof overlaps with the apparatus-side contact 104*b* in the longitudinal direction, the first end of the container body 70 interferes with the apparatus-side terminal 104 if the toner cartridge 50 being kept horizontally is put down into the apparatus body 100. Thus, installation of the toner cartridge 50 is hindered. In this configuration, as shown in FIG. 24, when the toner cartridge 50 is brought into contact with the installation guide face 212 during installation, the toner cartridge 50 can be inclined with the second end lifted. At that time, a lower corner of the flange 63 and the side face of the lower case 56 contact the installation guide face 212. When the toner cartridge 50 thus being inclined is moved down, the toner cartridge 50 can pass through space between the apparatus-side contact 104*b* and the second side wall 112 and is mounted in the container mount 106.

In the configuration in which the projection 210 includes the installation guide face 212, the toner cartridge 50 can slide in the direction B to the second-end side in conjunction with installation. Accordingly, it is preferable that, before fully mounted in the container mount 106, the toner cartridge 50 be slid back, to the side of the first end, to a predetermined position vertically above the container mount 106. Such operation can be achieved by the configuration shown in FIGS. 25A through 25D. Specifically, a tapered second-end guide face 220 is formed on the inner side of the second side wall 112. The second-end guide face 220 is positioned lower than the installation guide face 212 and inclined to the inner side of the apparatus body 100 as the position descends. Although the installation guide face 212 shifts the toner cartridge 50 in the direction B to the second-end side, the toner cartridge 50 can be returned to the predetermined position, being guided by the second-end guide face 220. Thus, the toner cartridge 50 can be mounted in the container mount 106 smoothly.

Next, descriptions are given below of installation and removal of the toner cartridge 50 with reference to FIGS. 25A through 25D.

Figure 25A:
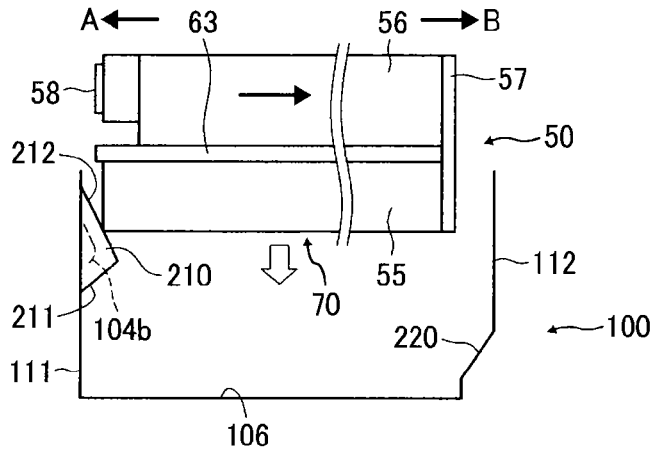
FIGS. 25A, 25B, 25C, and 25D are front views illustrating installation of the toner cartridge.
Figure 25B:
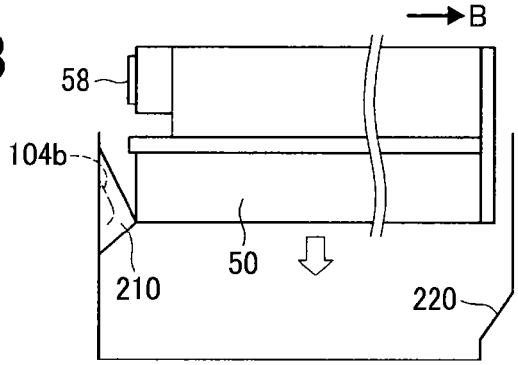
Figure 25C:
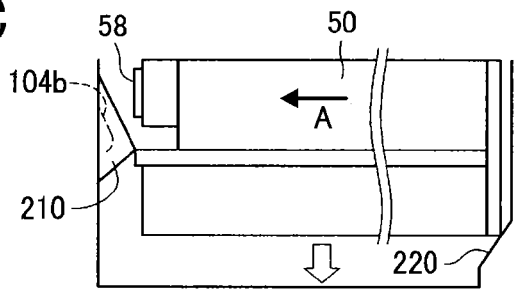
Figure 25D:
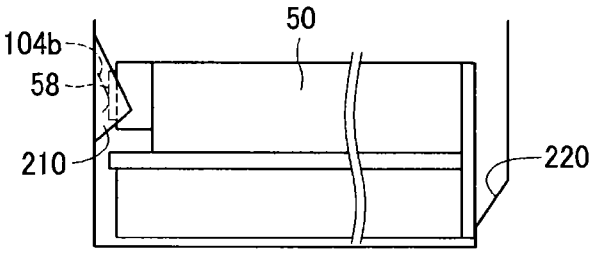

In installation of the toner cartridge 50, as the toner cartridge 50 is moved down, as shown in FIG. 25A, the lower corner at the first end of the toner cartridge 50 contacts the installation guide face 212. As the toner cartridge 50 is moved down further, as shown in FIG. 25B, the installation guide face 212 guides the toner cartridge 50 to slide in the direction B. As the toner cartridge 50 is moved down yet further, a lower corner at the second end of the toner cartridge 50 contacts the second-end guide face 220 as shown in FIG. 25C. Then, the toner cartridge 50 slides in the direction A, guided by the second-end guide face 220. At that time, since the second end of the toner cartridge 50 is protected by the gear cover 57, deformation of or damage to the gears 62 and 63 can be inhibited even upon the contact with the second-end guide face 220. By moving down the toner cartridge 50 from that position, the toner cartridge 50 can be set in position in the container mount 106.

Figure 23:
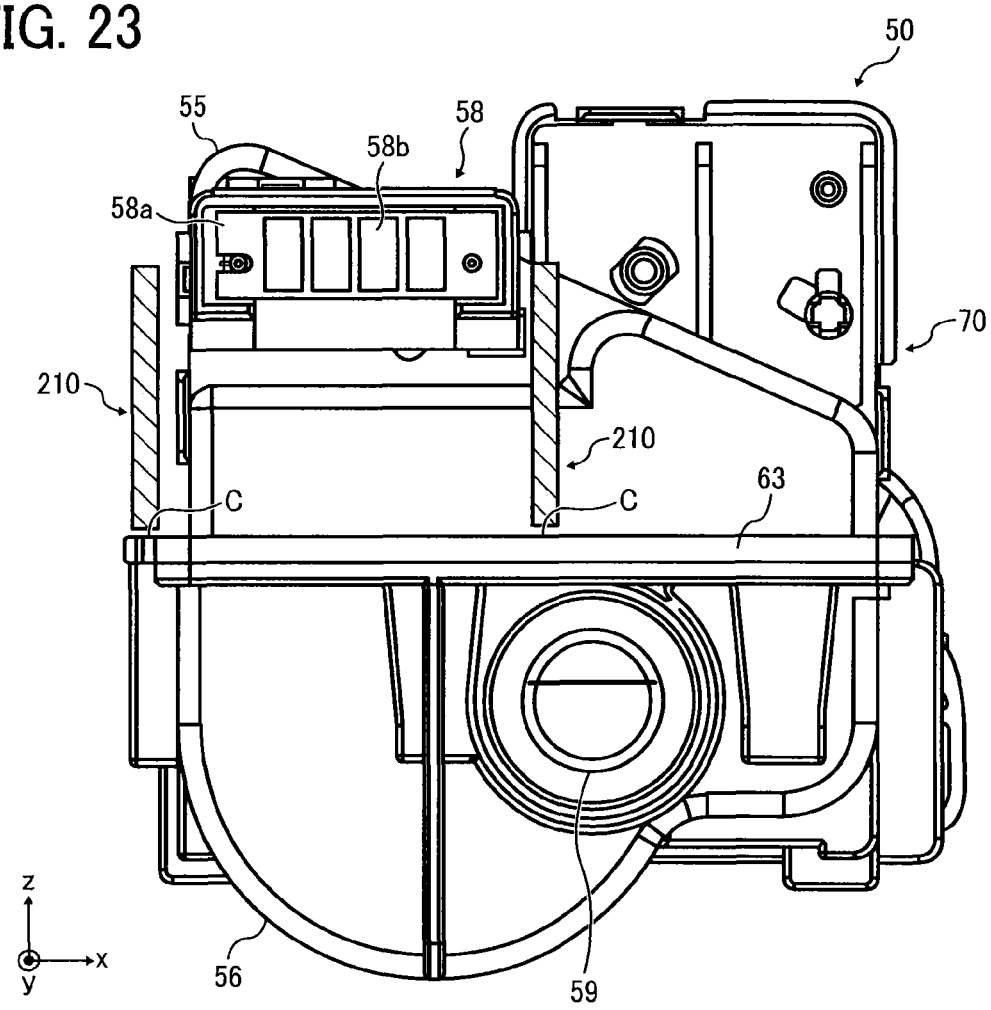
FIG. 23 is a side view of the first end portion of the toner cartridge.

As in FIG. 16, when the projections 210 are disposed across the apparatus-side terminal 104 in the direction X in FIG. 23, which is perpendicular to the direction Y (longitudinal direction of the toner cartridge 50), there are two contact portions C that contact the respective projections 210. With the projections 210 disposed on both sides of the apparatus-side terminal 104, even when the container body 70 contacts the projections 210 during installation or removal of the toner cartridge 50, a rotation moment on x-y plane does not act on the toner cartridge 50. This can secure smooth installation and removal of the toner cartridge 50. To secure such effects, it is preferable that the shape of the removal guide face 211 and that of the installation guide face 212 are identical between the two projections 210 and that the heights thereof are aligned to each other.

Although the description above with reference to FIGS. 25A through 25D concerns a case in which the toner cartridge 50 is kept horizontal during installation, the toner cartridge 50 can be guided by the installation guide face 212 and the second-end guide face 220 to the container mount 106 similarly in cases in which the posture of the toner cartridge 50 during installation is inclined such that the second end thereof is lifted or lowered. Therefore, the operator can mount the toner cartridge 50 in the container mount 106 easily by moving down the toner cartridge 50 simply without considering the posture.

By contrast, in removal of the toner cartridge 50, immediately after the start of removal operation, the area adjacent to the flange 63 at the first end of the container body 70 contacts the removal guide face 211. As the removal operation progresses, as shown in FIG. 21, while rotating around the first end or the adjacent portion, the toner cartridge 50 moves to the second-end side in the direction B, guided by the removal guide face 211. Accordingly, the toner cartridge 50 can be moved further in the removal direction and removed from the apparatus body 100 while avoiding the interference between the flange 63 and the apparatus-side contact 104*b*. While various postures of the toner cartridge 50 are possible depending on the operator's attention or the like during installation, removal of the toner cartridge 50 involves rotation of the toner cartridge 50.

In installation and removal of the toner cartridge 50, the timings at which the projection 101 is fitted in and disengaged from the groove 73, the timings at which the projection 79 is fitted in and disengaged from the guide groove 103, the timings at which the gear holder protrusion 71*b* abuts against and disengaged from the apparatus-side protrusion 102 (shown in FIGS. 18A, 18B, and 18C) can be independent of the timings at which the container body 70 contacts and is disengaged from the removal guide face 211, the installation guide face 212, and the second-end guide face 220. It is to be noted that, since the toner cartridge 50 slides in the directions A and B in removal of the toner cartridge 50 as described above, the above-described portions are designed not to hinder the above described movements to engage the counterpart, abut against the counterpart, and withdraw from the counterpart.

Figure 26:
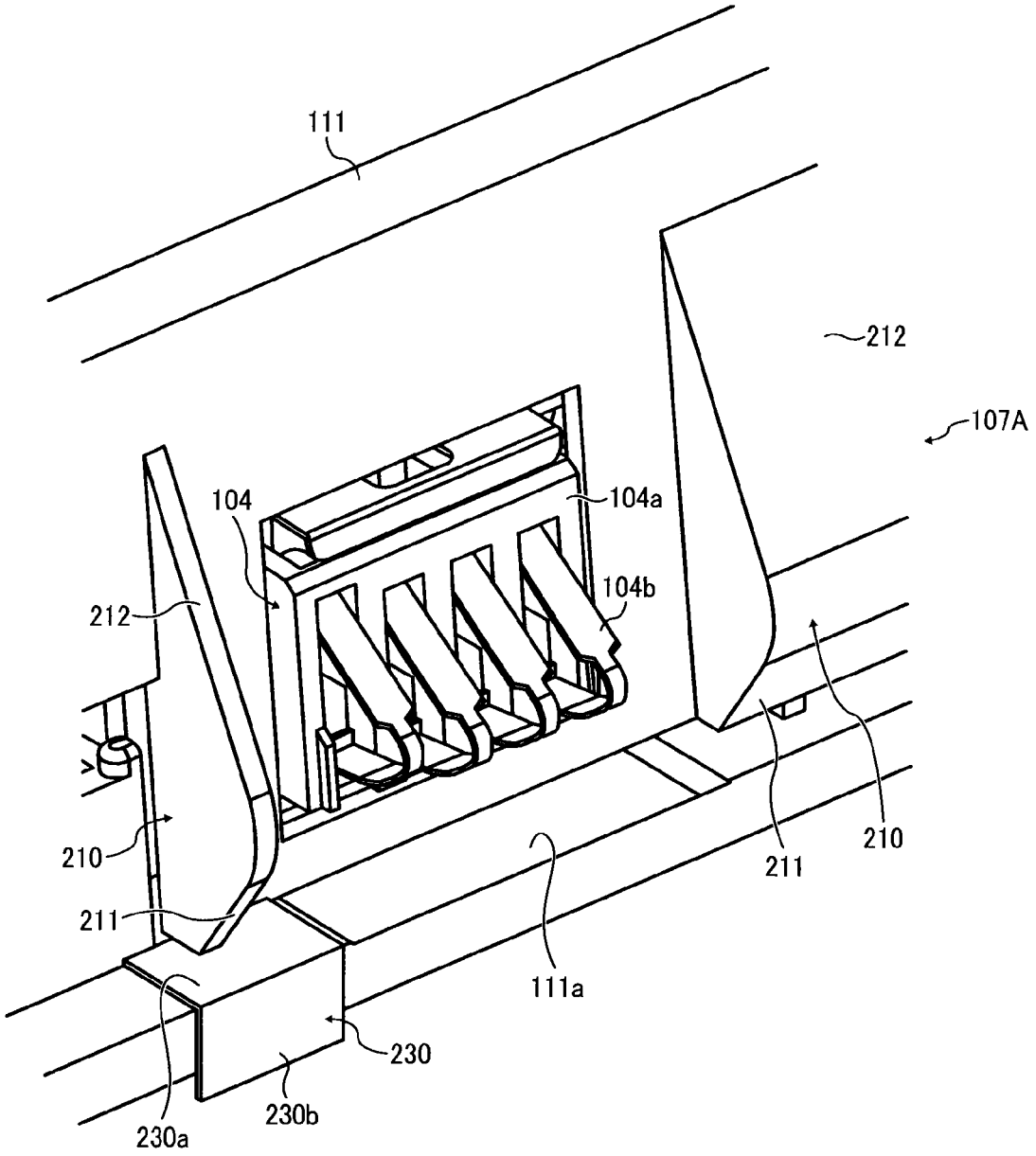
FIG. 26 is a perspective view of a first side wall provided with a retainer.
Figure 27A:
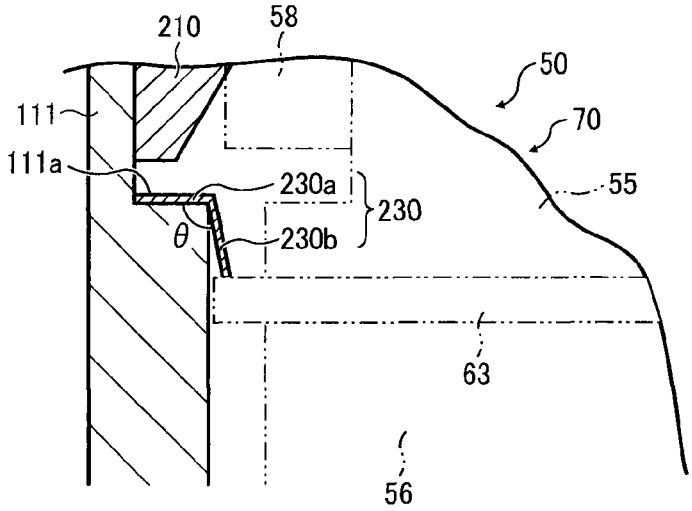
FIG. 27A is an enlarged cross-sectional view of a first end of the toner cartridge.

FIG. 26 illustrates a base 107A according to another embodiment of the present invention, in which the first side wall 111 is provided with a retainer 230 to clamp, from above, the toner cartridge 50 mounted in the container mount 106. Other than the differences described here, the base 107A has a configuration similar to that of the base 107 shown in FIG. 16. For example, the retainer 230 can be a leaf spring and include an attachment part 230*a* extending horizontally and an engaging part 230*b* extending downward from the attachment part 230*a*. Thus, in the configuration shown in FIG. 26, the retainer 230 is L-shaped in cross section. When no external force is exerted on the retainer 230, as shown in FIG. 27A, an angle θ of the engaging part 230*b* relative to the attachment part 230*a* is slightly greater than 90 degrees.

The retainer 230 is attached to the first side wall 111 such that an end of the engaging part 230*b* engages, from above, the flange 63 of the toner cartridge 50 mounted in the container mount 106. In the configuration shown in FIG. 26, the attachment part 230*a* is attached to a step 111*a* positioned beneath one of the projections 210 and in an intermediate portion in the direction of height of the first side wall 111.

Figure 27B:
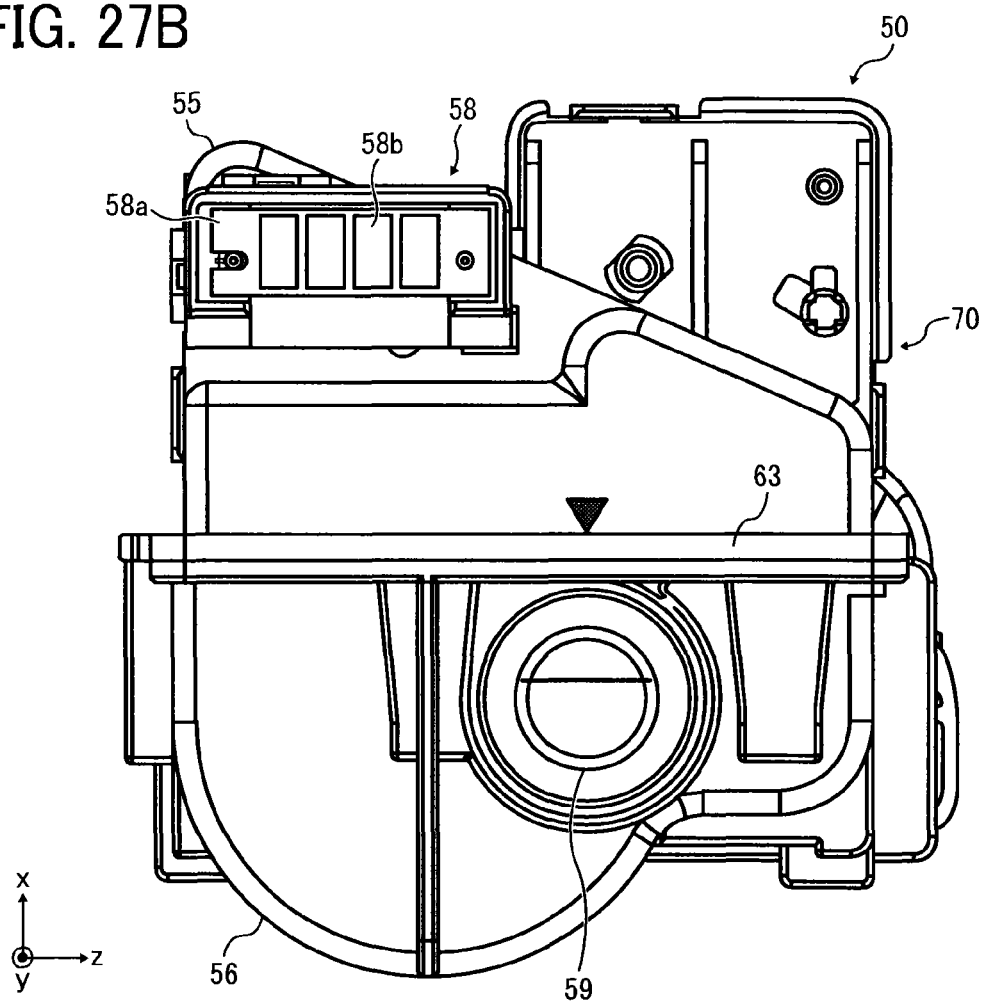
FIG. 27B is a side view of the first end of the toner cartridge.

When the toner cartridge 50 is installed in such a configuration, the engaging part 230*b* abuts against the flange 63 of the toner cartridge 50 and elastically deforms in the direction in which the angle θ decreases, being pushed by the flange 63. As indicated by chain double-dashed lines in FIG. 27A, when the toner cartridge 50 is mounted in the container mount 106, the retainer 230 elastically reverts to the initial shaped, and the end of the engaging part 230*b* presses against an upper face of the flange 63. This configuration can inhibit the toner cartridge 50 mounted in the container mount 106 from floating up. At that time, it is advantageous to restrain, with the retainer 230, a portion substantially intermediate in the direction perpendicular to the longitudinal direction of the flange 63, as indicated by black triangle shown in FIG. 27B, for inhibiting the rotation moment on x-z plane from exerting on the toner cartridge 50 and in stabilizing the posture of the toner cartridge 50 being installed.

When the toner cartridge 50 is removed from the apparatus body 100, as described above, the toner cartridge 50 rotates (or pivots) about the periphery of the portion retained by the retainer 230. Accordingly, engagement between the engaging part 230*b* and the flange 63 can be canceled easily. Therefore, the engaging part 230*b* can be inhibited from hindering removal of the toner cartridge 50.

Thus, the above-described embodiments concern replaceable units (such as developer containers or process units) mountable and removable from apparatuses (such as image forming apparatuses) by operators or users and provided with the container-side terminal disposed at the first end in the longitudinal direction thereof to connect to the apparatus-side terminal of the apparatus.

According to an aspect of the present specification, a component of the apparatus body contacts a contact portion of the replaceable unit positioned at the first end of the developer container immediately after the start of installation. Additionally, the replaceable unit is designed such that the second end is moved in the removal direction before the first end is moved in that direction in removal of the replaceable unit.

Specific aspects of the above-described embodiments are as follows.

In the above-described embodiments, in removal of the toner cartridge 50, the contact portion C positioned at the first longitudinal end of the toner cartridge 50 is brought into contact with a component, such as the projection 210, of the apparatus body 100, and the second longitudinal end of the toner cartridge 50 is disengaged from the apparatus body 100 (or moved in the removal direction) before the first longitudinal end thereof is disengaged from the apparatus body 100. Accordingly, the toner cartridge 50 can be moved in the removal direction while the first end thereof is withdrawn from the apparatus-side terminal 104.

Thus, according to the above-described aspect, the collision between the first end of the toner cartridge 50 and the apparatus-side terminal 104 can be avoided although, in configurations in which the apparatus-side terminal projects beyond the inner side wall of the apparatus body to the inner side of the apparatus body, the replaceable unit being installed or removed may hit the apparatus-side terminal (the risk can be higher in removal).

Accordingly, deformation or damage to the terminal can be inhibited. Therefore, it is not necessary to reduce the longitudinal length of the replaceable unit (sacrifice the capacity of the replaceable unit) to secure clearance between the apparatus-side terminal and the side face of the replaceable unit mounted in the apparatus body to reduce such a risk. In the case of toner cartridges, reduction in capacity of the toner cartridge means a hindrance to compactness of the image forming apparatus.

Therefore, the capacity of the toner cartridge 50 serving as the developer container can be increased, and accordingly the image forming apparatus can become more compact.

By providing, to the apparatus body 100, the projection 210 projecting to the inner side of the apparatus body 100 to abut against the first end of the toner cartridge 50 immediately after the start of removal of the toner cartridge 50, the second longitudinal end of the toner cartridge 50 can be moved in the removal direction before the first longitudinal end thereof is moved in the removal direction, thus facilitating rotation of the toner cartridge 50. This can inhibit collision between the first end of the toner cartridge 50 and the apparatus-side terminal 104, which tends to occur in removal of the toner cartridge 50.

Prevention of collision between the first end of the toner cartridge 50 and the apparatus-side terminal 104 during installation and removal of the toner cartridge 50 can be secured by the arrangement in which the apparatus-side terminal 104 includes the contact 104*b* projecting to the inner side of the apparatus body 100 and the contact 104*b* is positioned inside the area of the projection 210 projected on the plane that includes the trajectory of the toner cartridge 50 being removed.

When the tapered removal guide face 211 that contacts the first end of the toner cartridge 50 being removed is formed on the projection 210, the toner cartridge 50 can be guided to the second-end side during the removal operation, thus making the removal operation smooth.

When the tapered installation guide face 212 that contacts the first end of the toner cartridge 50 being installed is formed on the projection 210, the toner cartridge 50 can be guided to the second-end side during the installation operation, thus making the installation operation smooth.

The tapered second-end guide face 220 provided to the apparatus body 100 contacts the second end of the toner cartridge 50 after the first end of the toner cartridge 50 being installed contacts the installation guide face 212 of the projection 210. With this configuration, the toner cartridge 50, which has been shifted to the second-end side by the installation guide face 212, can be guided by the second-end guide face 220 back to the predetermined position. Thus, the toner cartridge 50 can be mounted in the container mount 106 smoothly.

Since the projections 210 are disposed on the respective sides of the apparatus-side terminal 104, even when the toner cartridge 50 contacts the projections 210 during installation or removal of the toner cartridge 50, rotation moment on the plane perpendicular to the longitudinal direction thereof does not act on the toner cartridge 50. This can secure smooth installation and removal of the toner cartridge 50.

Since the grip 61 gripped by the operator or user in installation or removal is shifted from the center to the second end in the longitudinal direction of the toner cartridge 50, rotation moment can be given to the toner cartridge 50 in removal thereof. Accordingly, the operator or user can rotate the toner cartridge 50 without the operator's attention and remove it from the apparatus body 100.

The development housing 40 that contains developer (e.g., toner), the developing roller 41 to carry toner in the development housing 40 and supply the toner to the latent image on the photoreceptor 2 (i.e., latent image bearer), and the toner cartridge 50 to supply toner to the interior of the development housing 40 can together form the developing device 4. Further, the photoreceptor 2 to bear the latent image on its surface and the developing device 4 can together form the process unit.

Referring to FIGS. 28 through 31, an image forming apparatus 2000 according to another embodiment of the present invention is described below. In the description below, only differences from the above-described embodiments are described.

Figure 28:
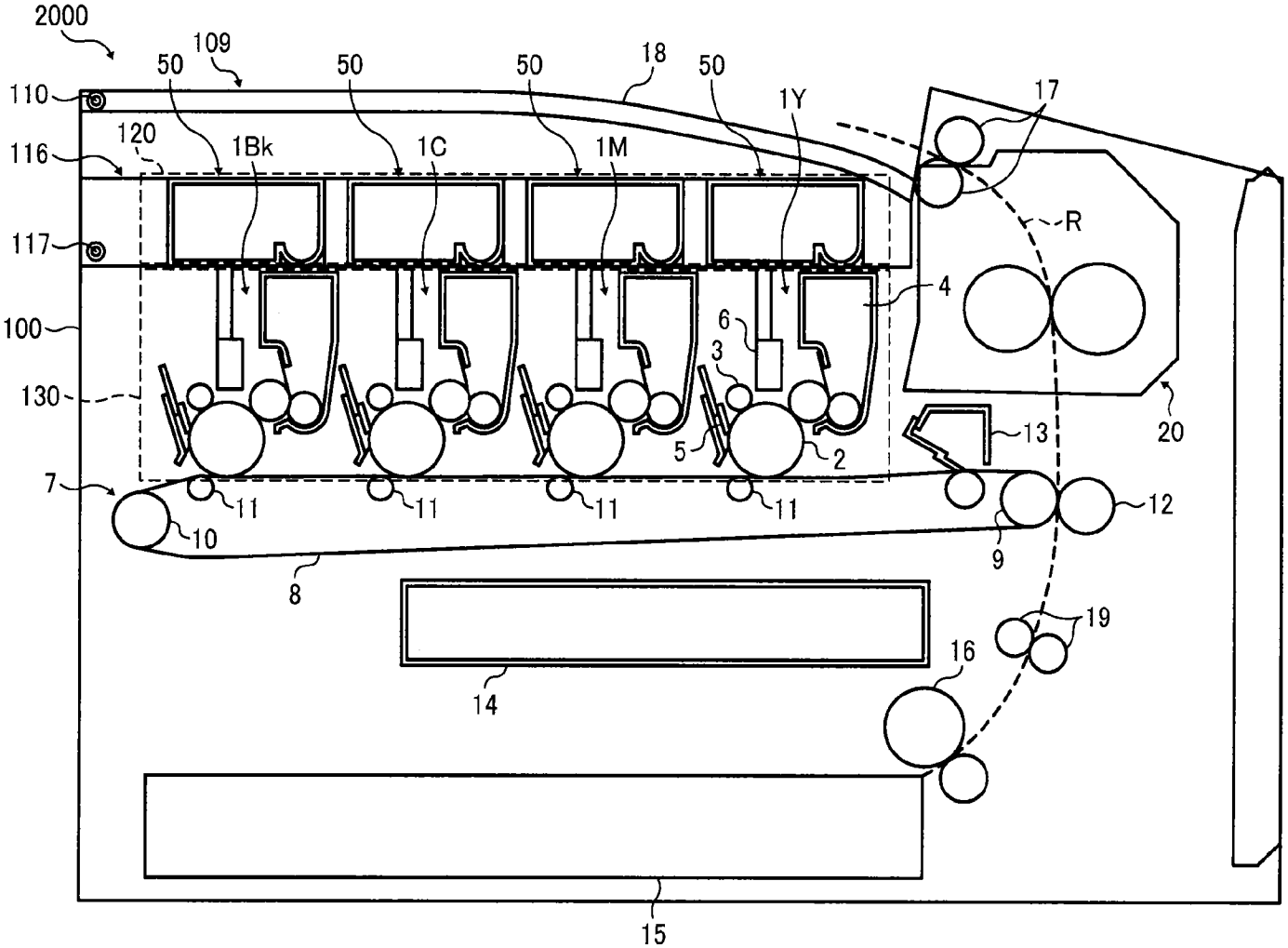
FIG. 28 is a schematic view of an image forming apparatus according to another embodiment of the present invention.

As shown in FIG. 28, the image forming apparatus 2000 includes the upper cover 109, serving as a first cover, disposed above the apparatus body 100, a container mounting section 120 in which the toner cartridge 50 is installable when the upper cover 109 is opened, an openably closable internal cover 116, serving as a second cover disposed on the inner side of the container mounting section 120 (that is, positioned deeper in the apparatus body 100 than the container mounting section 120), and a process unit mount 130 in which the process units 1Y, 1M, 1C, and 1Bk are removably installable.

Figure 29:
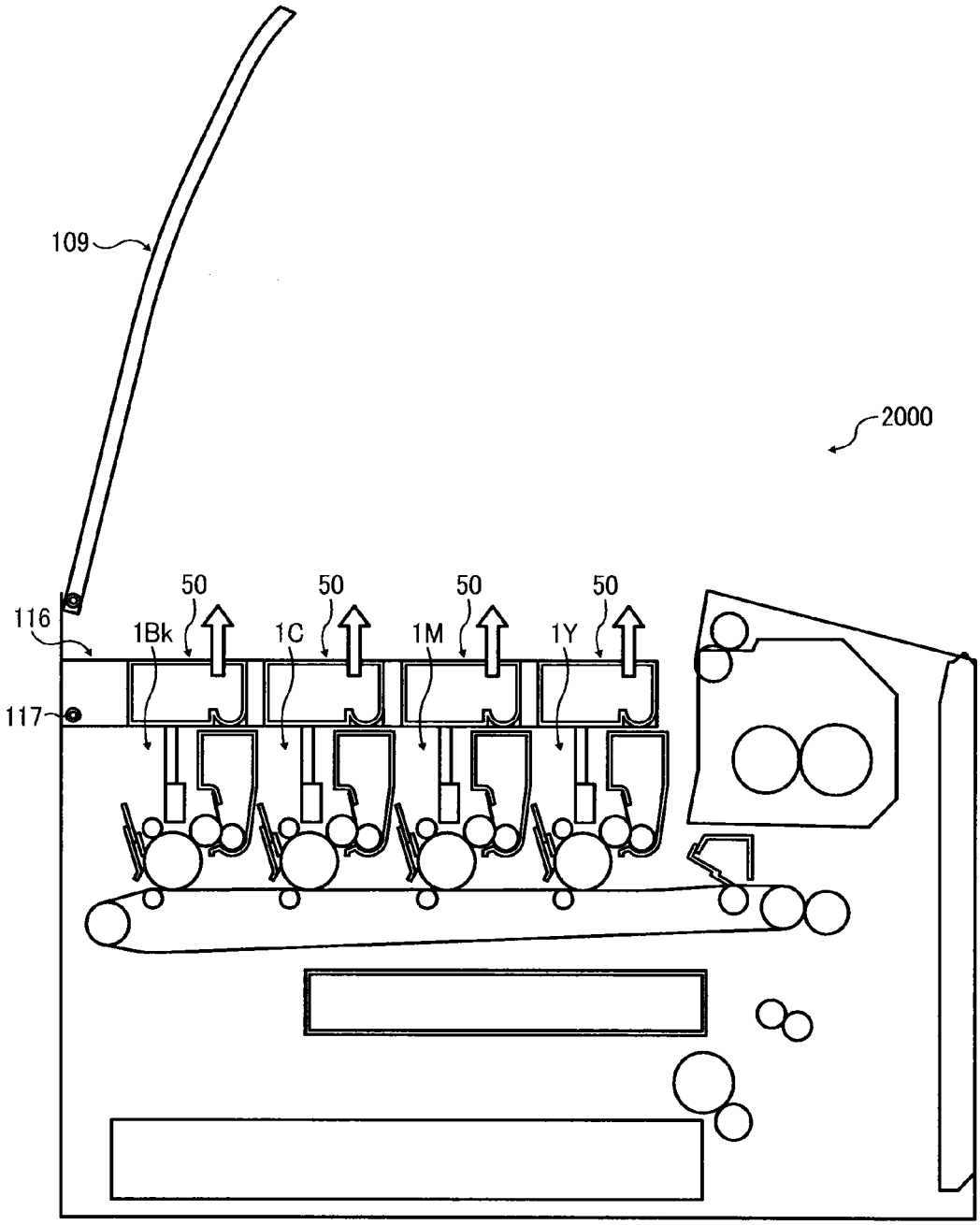
FIG. 29 is a schematic view illustrating a state in which an upper cover is open in the image forming apparatus shown in FIG. 28.
Figure 30:
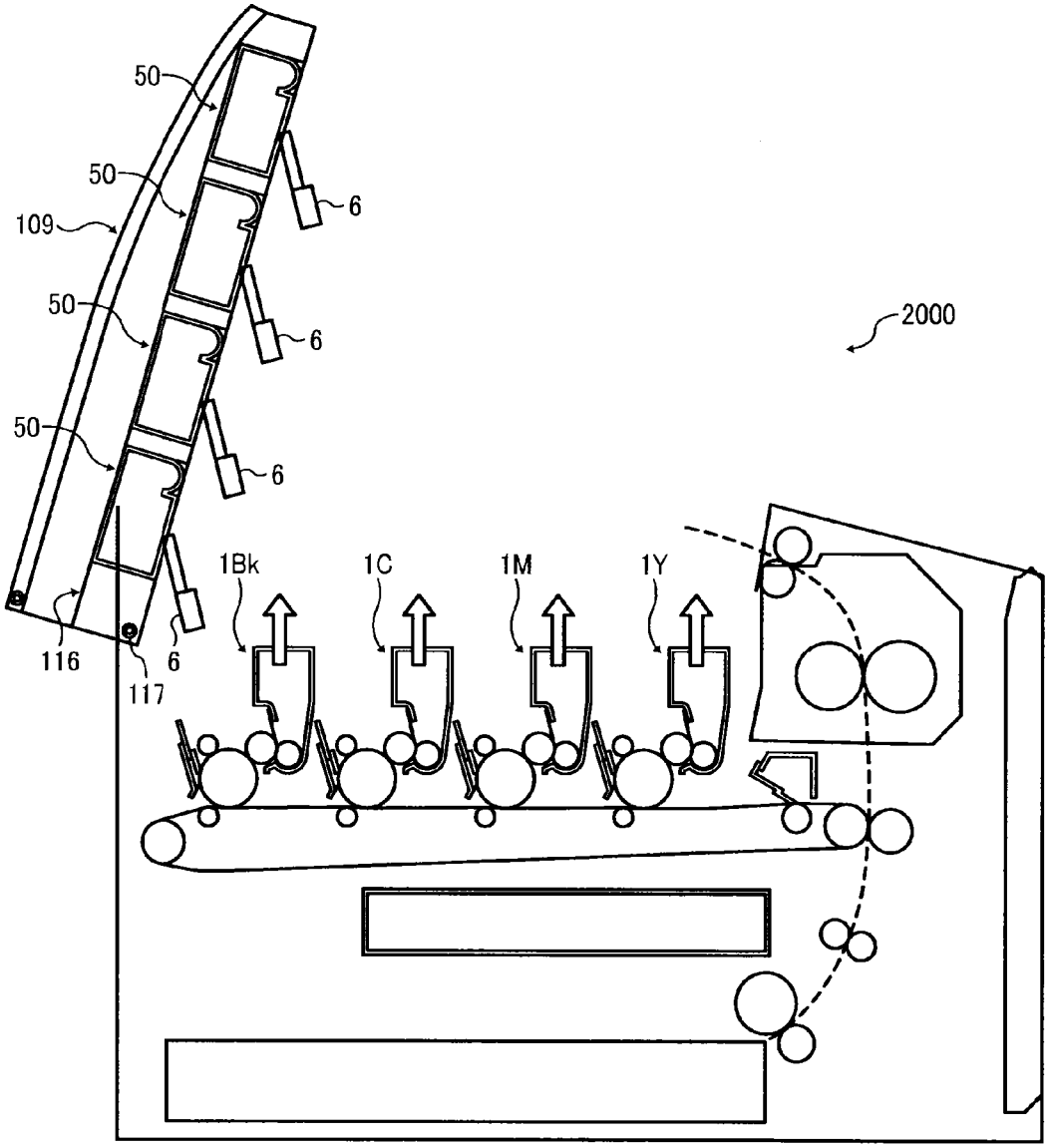
FIG. 30 is a schematic view illustrating a state in which the upper cover and an inner cover are open in the image forming apparatus shown in FIG. 28.

FIG. 29 is a schematic view illustrating a state in which the upper cover 109 is open, and FIG. 30 is a schematic view illustrating a state in which also the internal cover 116 is open.

Specifically, the internal cover 116 is hinged to the apparatus body 100. The internal cover 116 can pivot about a fulcrum 117 and be opened or closed vertically relative to the apparatus body 100. The toner cartridges 50 can be mounted on the internal cover 116. The multiple container mounts 106, in which the respective toner cartridges 50 are mounted, are formed on an upper face of the internal cover 116 similarly to the partition 108 (shown in FIGS. 1 and 15) of the above-described embodiment. As shown in FIG. 29, the toner cartridges 50 can be installed in and removed from the image forming apparatus 2000 when the upper cover 109 is open.

The process units 1Y, 1M, 1C, and 1Bk are accommodated inside or beneath the internal cover 116. Therefore, to install and remove the process units 1, both the upper cover 109 and the internal cover 116 are opened as shown in FIG. 30. Additionally, the multiple exposure devices 6, such as light-emitting diode (LED) units, to expose the photoreceptors 2 are swingably attached to the lower face of the internal cover 116. With this configuration, as the internal cover 116 is opened and closed, each exposure device 6 can be guided by a guide between a position close to the photoreceptor 2 and the position withdrawn upward therefrom while avoiding interference with the process unit 1.

With the above-described configuration, as the internal cover 116 is opened, the toner cartridges 50 attached thereto can be moved away from the process units 1. Accordingly, the process units 1 can be installed to and removed from the apparatus body 100 without removing the toner cartridges 50. This configuration can enhance operability in replacement of the process units 1 and reduce the risk of toner scattering from the toner cartridges 50 to the interior of the apparatus.

By contrast, the process units 1 are not recognizable in a state in which the internal cover 116 is closed, and, when the two or more of the process units 1 are to be replaced at a time, the operator may forget to install one or more process units in the apparatus and close the internal cover 116 and the upper cover 109. In such a case, if the discharge opening 52 of the toner cartridge 50 is opened at the position corresponding to the process unit 1 that is not installed, toner can scatter inside the apparatus.

Figure 31:
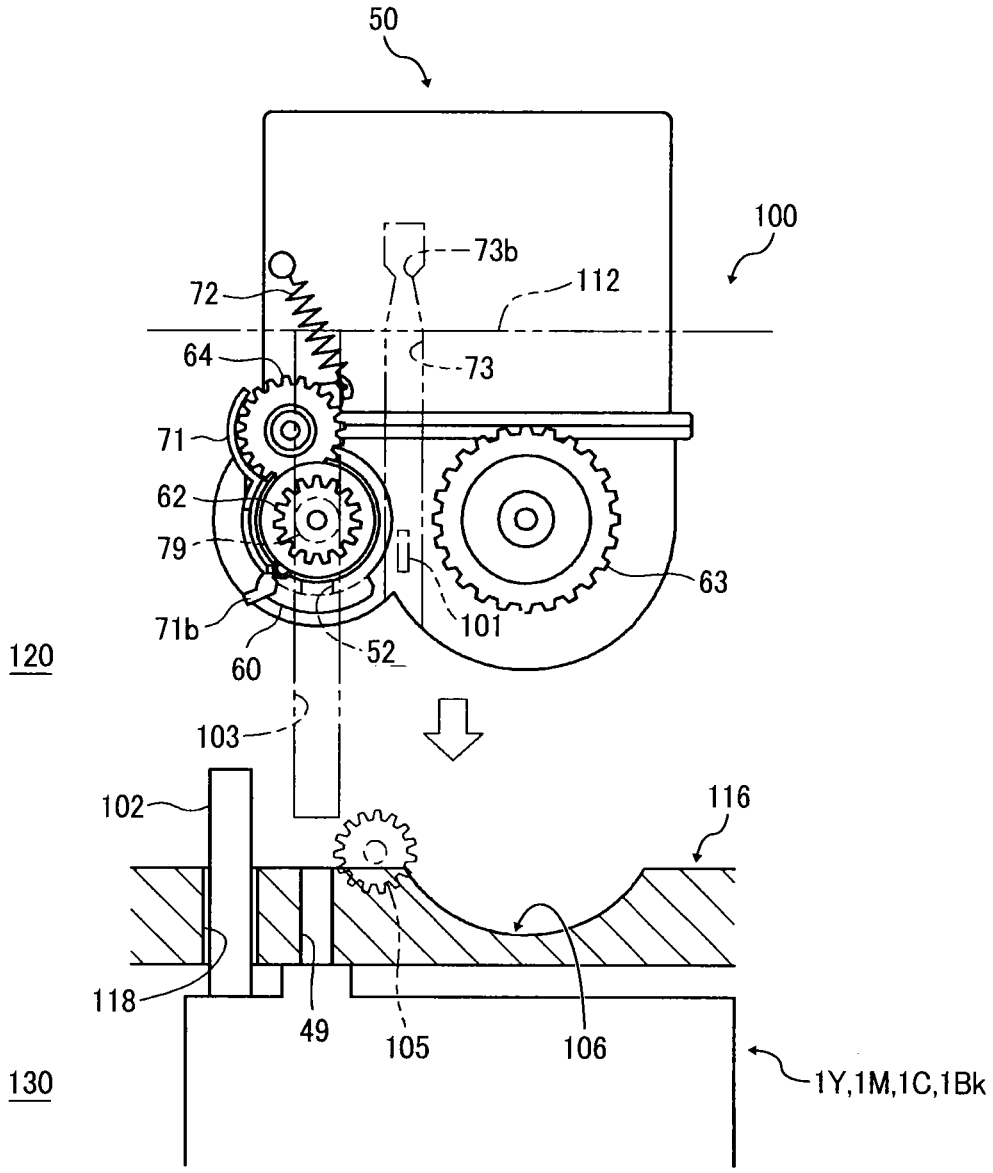
FIG. 31 is a schematic view of a process unit provided with a contact portion.

In view of the foregoing, to prevent toner scattering, the apparatus-side protrusion 102 (serving as a shutter opener) to open the external shutter 60 is provided to the process unit 1 as shown in FIG. 31. Accordingly, a through hole 118 is formed in the internal cover 116 to allow the apparatus-side protrusion 102 to penetrate it. With this configuration, when the internal cover 116 is closed with the process units 1 installed in the apparatus, the apparatus-side protrusion 102 inserted into the through hole 118 projects into the container mounting section 120.

In this configuration, the apparatus-side protrusion 102 to open the external shutter 60 is not present in portions without process units, thus preventing opening the external shutter 60 in such portions. Consequently, even if the internal cover 116 is closed in a state in which one or more process cartridges 50 are absent, the external shutter 60 is not opened in such portions, thus preventing scattering of toner caused thereby.

Although the differences of the configuration shown in FIGS. 28 through 31 from the configurations shown in FIGS. 1 through 27B are thus described, the portions of configuration shown in FIGS. 28 through 31 similar to those of the previous embodiments can operate similarly and attain similar effects.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an apparatus body including an apparatus-side terminal provided to a first inner side wall of the apparatus body;

a developer container to contain developer, removably installable in the apparatus body, the developer container including a container-side terminal disposed in a first end portion of the developer container in a longitudinal direction thereof, the container-side terminal electrically connectable to the apparatus-side terminal;

an apparatus-side protrusion that projects inward from the first inner side wall below an upper portion of the first inner side wall and above a lower portion of the first inner side wall of the apparatus body to contact the first end portion of the developer container immediately after removal of the developer container from the apparatus body is started; and an additional apparatus-side protrusion that projects inward from the first inner side wall of the apparatus body and is positioned across the apparatus-side terminal from the apparatus-side protrusion, wherein, in removal of the developer container from the apparatus body, a second end portion of the developer container in the longitudinal direction is disengaged from the apparatus body before the first end portion is disengaged from the apparatus body.

2. The image forming apparatus according to claim 1, wherein the apparatus-side terminal comprises a contact that projects to an inner side of the apparatus body, and the contact is disposed inside a projection area of the apparatus-side protrusion on a plane including a trajectory of the developer container being removed from the apparatus body.

3. The image forming apparatus according to claim 1, wherein the apparatus-side protrusion comprises a tapered removal guide face to contact the first end portion of the developer container being removed from the apparatus body.

4. The image forming apparatus according to claim 3, wherein the apparatus-side protrusion further comprises a tapered installation guide face to contact the first end portion of the developer container moving in an installation direction.

5. The image forming apparatus according to claim 4, wherein the apparatus body further comprises a second-end guide face provided to a second inner side wall of the apparatus body facing the first inner side wall, the second-end guide face positioned downstream from the installation guide face of the apparatus-side protrusion in the installation direction, and the second end portion of the developer container moving in the installation direction contacts the second-end guide face after the first end portion of the developer container contacts the installation guide face.

6. The image forming apparatus according to claim 1, wherein the developer container further comprises a grip for being gripped by an operator in installation and removal of the developer container, the grip shifted to the second end portion from a longitudinal center position of the developer container.

7. The image forming apparatus according to claim 1, wherein the apparatus-side protrusion projects to a position overlapping with the first end portion of the developer container in a state in which the developer container is installed in the apparatus body.

8. A developer container to contain developer, removably installable in an apparatus body of an image forming apparatus, the developer container comprising:

a container-side terminal disposed in a first end portion of the developer container in a longitudinal direction thereof, the container-side terminal electrically connectable to an apparatus-side terminal provided to the apparatus body;

a grip for being gripped by an operator in installation and removal of the developer container, the grip shifted to a second end portion from a longitudinal center of the developer container; and a shutter to open a discharge opening in conjunction with installation of the developer container and to close the discharge opening in conjunction with removal of the developer container, wherein the discharge opening is formed only in the second end portion of the developer container to discharge developer contained inside the developer container.

9. A developing device comprising:

a development housing to contain developer;

a developer bearer to supply developer contained in the development housing to a latent image formed on a latent image bearer; and the developer container according to claim 8 to contain developer supplied to the development housing.

10. A process unit removably installable in an apparatus body of an image forming apparatus, the process unit comprising:

the developing device according to claim 9; and the latent image bearer on which a latent image is formed.

11. A replaceable unit removably installable in an apparatus, the replaceable unit comprising:

a terminal disposed in a first end portion of the replaceable unit in a longitudinal direction thereof, the terminal electrically connectable to an apparatus-side terminal provided to the apparatus; and a grip for being gripped by an operator in installation and removal of the replaceable unit, the grip shifted to a second end portion from a longitudinal center of the replaceable unit, wherein a lower portion of the first end portion is last to exit the apparatus in removal of the replaceable unit and extends a distance greater than or equal to an upper portion of the first end in the longitudinal direction, wherein the lower portion of the first end is comprised in a lower case of a container body and the upper portion of the first end is comprised in an upper case of the container body, and wherein a middle portion of the first end, which middle portion is disposed between the lower portion and the upper portion, extends a distance less than the lower portion and less than the upper portion in the longitudinal direction.

12. The replaceable unit according to claim 11, wherein the lower portion includes a flange portion formed at a joint between the upper and lower cases.

13. The replaceable unit according to claim 12, wherein the flange portion extends the distance greater than or equal to the upper portion of the first end in the longitudinal direction.

* * * * *